US012473813B2

(12) United States Patent
Trunk et al.

(10) Patent No.: US 12,473,813 B2
(45) Date of Patent: Nov. 18, 2025

(54) DETECTING RINGOUT ON AN EXPANDABLE TOOL

(71) Applicant: Schlumberger Technology Corporation, Sugar Land, TX (US)

(72) Inventors: Philip Trunk, Houston, TX (US); Balasubramanian Durairajan, Sugar Land, TX (US); Stephen Michael Cordes, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/414,046

(22) Filed: Jan. 16, 2024

(65) Prior Publication Data

US 2025/0230741 A1 Jul. 17, 2025

Related U.S. Application Data

(63) Continuation-in-part of application No. 18/413,703, filed on Jan. 16, 2024.

(51) Int. Cl.
*E21B 44/00* (2006.01)
*E21B 7/28* (2006.01)

(52) U.S. Cl.
CPC ..... *E21B 44/00* (2013.01); *E21B 7/28* (2013.01)

(58) Field of Classification Search
CPC ..... E21B 10/32; E21B 10/322; E21B 10/325; E21B 10/327; E21B 10/34; E21B 10/345
See application file for complete search history.

(56) References Cited

U.S. PATENT DOCUMENTS

2014/0182934 A1* 7/2014 Samuel ..... E21B 44/04 175/40
2015/0322767 A1* 11/2015 Samuel ..... E21B 10/26 175/27
2018/0051548 A1* 2/2018 Liu ..... E21B 47/12
2018/0163480 A1* 6/2018 Evans ..... E21B 10/325
2024/0242326 A1* 7/2024 Chowhan ..... G06T 7/521

* cited by examiner

*Primary Examiner* — David Carroll
(74) *Attorney, Agent, or Firm* — Jeffrey D. Frantz

(57) ABSTRACT

A ringout detection system may receive a plurality of surface weight-on-bit (SWOB) measurements from a surface weight-on-bit (WOB) sensor and a plurality of downhole weight-on-bit (DWOB) measurements from a downhole WOB sensor. A ringout detection system may identify a decrease in a WOB ratio between the plurality of SWOB measurements and the plurality of DWOB measurements. A ringout detection system may determine that the decrease in the WOB ratio exceeds a WOB ratio threshold. A ringout detection system may identify that ringout has occurred at the reamer based at least in part on the decrease in the WOB ratio.

20 Claims, 19 Drawing Sheets

DETECTING RINGOUT ON AN EXPANDABLE TOOL

CROSS-REFERENCE TO RELATED APPLICATIONS

The present application is a continuation-in-part of U.S. patent application Ser. No. 18/413,703 titled "BREAK AND WEAR INDICATOR FOR EXPANDABLE DOWNHOLE TOOL" filed Jan. 16, 2024, the disclosure of which is incorporated herein by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled. In some situations, an expandable downhole tool may expand the diameter of the wellbore, cut a portion of the casing, or perform any other cutting activity. Some downhole tools may include cutter blocks that may be selectively expanded.

In some situations, an expandable downhole tool may experience wear which may result in a reduced diameter of the expandable downhole tool. This may cause the expandable downhole tool to be ineffective at expanding the diameter of the wellbore. It may be difficult to know when the expandable downhole tool experiences wear. As a result, a drilling operation may employ an ineffective expandable downhole tool for a significant and costly amount of time before taking mitigating measures. Due to the difficulty in detecting wear, it may also be difficult to know at what location or depth the expandable downhole tool became ineffective, and what corresponding portion of the borehole is deficient. This may become costly and burdensome to the drilling operation. For this purpose, it may be advantageous to detect wear of an expandable downhole tool.

SUMMARY

In some aspects, the techniques described herein relate to a method implemented in a drilling system operating a reamer and a bit. A ringout detection system receives a plurality of surface weight-on-bit (SWOB) measurements from a surface weight-on-bit (WOB) sensor and a plurality of downhole weight-on-bit (DWOB) measurements from a downhole WOB sensor. The ringout detection system identifies a decrease in a WOB ratio between the plurality of SWOB measurements and the plurality of DWOB measurements. The ringout detection system determines that the decrease in the WOB ratio exceeds a WOB ratio threshold. The ringout detection system identifies that ringout has occurred at the reamer based at least in part on the decrease in the WOB ratio.

In some aspects, the techniques described herein relate to a method implemented in a drilling system operating a reamer and a bit. A ringout detection system receives a plurality of surface weight-on-bit (SWOB) measurements from a surface weight-on-bit (WOB) sensor and a plurality of surface torque measurements from a surface torque sensor. The ringout detection system identifies a decrease in a surface torque ratio between the plurality of SWOB measurements and the plurality of surface torque measurements. The ringout detection system determines that the decrease in the surface torque ratio exceeds a surface torque threshold. The ringout detection system and identifies that ringout has occurred at the reamer based at least in part on the decrease in the surface torque ratio.

In some aspects, the techniques described herein relate to a method implemented in a drilling system operating a reamer and a bit. A ringout detection system receives a plurality of surface weight-on-bit (SWOB) measurements from a surface weight-on-bit (WOB) sensor, a plurality of downhole weight-on-bit (DWOB) measurements from a downhole WOB sensor, a plurality of surface torque measurements from a surface torque sensor, a plurality of downhole torque measurements from a downhole torque sensor, and a rate of penetration (ROP). The ringout detection system identifies a measurement pattern over a period, the measurement pattern including a DWOB decrease in the plurality of DWOB measurements, a downhole torque decrease in the plurality of downhole torque measurements, a surface torque decrease based on the plurality of surface torque measurements, a ROP decrease, and a consistent SWOB of the plurality of SWOB measurements. The ringout detection system determines that ringout has occurred based at least in part on the measurement pattern over the period.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of a representation of an expandable tool, according to at least one embodiment of the present disclosure;

FIG. 2-2 is a representation of an expandable block of FIG. 2-1;

FIG. 2-3 is a side cross-sectional view of the expandable block of FIG. 2-1;

FIG. 2-4 is a representation of the expandable block of FIG. 2-3 having experienced partial ringout;

FIG. 2-5 is a representation of the expandable block of FIG. 2-3 having experienced partial ringout;

FIG. 2-6 is a representation of the expandable block of FIG. 2-3 having experienced full ringout;

FIG. 3 is a representation of a ringout detection system, according to at least one embodiment of the present disclosure;

FIG. 4 is a schematic representation of a drilling parameter plot, according to at least one embodiment of the present disclosure;

FIG. 5 is a schematic representation of a drilling parameter plot, according to at least one embodiment of the present disclosure;

FIG. 6 is a schematic representation of a drilling parameter plot, according to at least one embodiment of the present disclosure;

FIG. 9-1 is a representation of a multi-profile reamer, according to at least one embodiment of the present disclosure;

FIG. 9-2 is a representation of the multi-profile reamer of FIG. 9-1 with the first profile worn;

DETAILED DESCRIPTION

This disclosure generally relates to devices, systems, and methods for identifying ringout in a reamer. During drilling operations, a reamer may engage the wellbore to expand the wellbore's diameter. The reamer may experience wear, which may reduce the diameter of the reamer. In some situations, the reamer may experience ringout, or a reduction in the diameter of the wellbore that reduces the cutting effectiveness of the reamer. This may reduce the weight the reamer supports and/or the torque applied to the drilling system through the reamer. Ringout may be difficult to identify because the weight supported by the reamer and the torque applied to the drilling system through the reamer may be small. In some situations, ringout may be difficult to identify because the rate of wear on the reamer may be fast based on the relatively low volume of material in the reamer blocks.

In accordance with at least one embodiment of the present disclosure, the reamer may include a brake element that is oriented such that the brake element does not effectively cut the formation. The brake element may increase the weight supported by the reamer and/or reduce the torque on the drilling system. This may reduce the torque at the surface and/or reduce the torque at the bit and the downhole weight-on-bit (DWOB), with a resulting change in the rate of penetration (ROP). A ringout detection system may detect whether ringout has occurred at the reamer by measuring and/or inferring one or more of the surface weight-on-bit (SWOB), DWOB, downhole weight-on-reamer (DWOR), surface torque, downhole torque-on-bit (DTOB), downhole torque-on-reamer (DTOR), or ROP and determining whether the change in these elements is associated with ringout. In this manner, the ringout detection system may determine whether ringout has occurred. This may allow the drilling operator to make changes to a drilling system to reduce the impact of the ringout on the drilling system.

Figure 1:
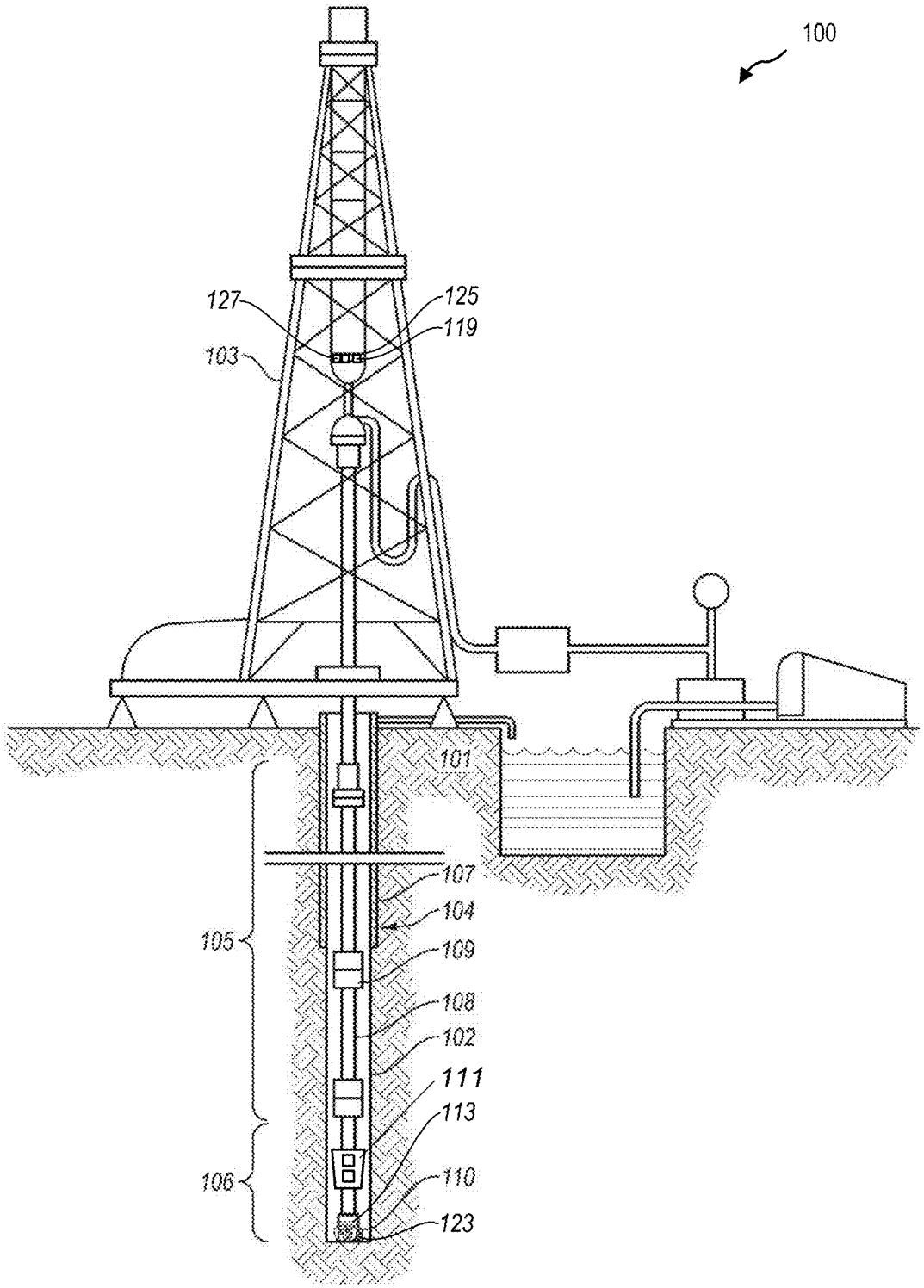
FIG. 1 is a representation of a drilling system for drilling an earth formation to form a wellbore, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

In accordance with at least one embodiment of the present disclosure, the brake element may allow a drilling operator located at the surface to detect that the expandable reamer has worn to less than the gauge diameter at the location of the brake element. This may indicate that the expandable reamer is at a risk of experiencing ringout and/or has experienced ringout. When the brake element engages the borehole wall and/or a ledge in the borehole, it may not efficiently cut the borehole wall and/or may prohibit efficient movement of the expandable reamer down the borehole. For example, the brake element may be oriented with a different rake angle and/or profile angle than the cutting elements of the expandable blade. This may result in a reduction in torque on the reamer ("TOR"), an increase in weight on the reamer ("WOR"), a decrease in rate of penetration ("ROP") of a downhole system, and combinations thereof. In this manner, by observing one or more of these changes in operation of the expandable tool, a drilling operator may detect that the expandable downhole tool is worn below the threshold level of wear.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105. The drill rig 103 may include any type of drill rig. For example, the drill rig 103 may include a top drive. A top drive drill rig may include a rotary table and a hook. The hook may support the drill string 105 and lower the drill string 105 into the wellbore 102. The rotary table may rotate the drill string 105, including the elements of the drilling tool assembly 104, such as an expandable tool 111 and/or the bit 110.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The expandable tool 111 may be coupled to the BHA 106. The expandable tool 111 may be any type of expandable tool, such as an expandable reamer, an expandable stabilizer, and expandable casing cutter, any other expandable tool, and combinations thereof. In some embodiments, multiple expandable tools 111 may be coupled to the BHA 106. In some embodiments, a single expandable tool 111 may be coupled to the BHA 106.

The expandable tool 111 may include an expandable block set having one or more expandable blocks. For example, the expandable tool 111 may be an expandable reamer having one or more reamer blocks. The expandable blocks may include one or more formation-engaging elements. For example, an expandable reamer block may include one or more cutting elements configured to degrade the formation to expand the diameter of the wellbore. In some examples, an expandable casing cutter may include one or more cutting elements configured to cut and remove a portion of a casing. In some examples, an expandable stabilizer block may include one or more wear elements configured to engage the formation and stabilize the BHA 106 and/or the drill string. At least one of the expandable blocks from the expandable block set may include one or more brake elements.

In some situations, as the expandable tool 111 engages the earth formation 101, one or more segments of the expandable block set may wear or break away from the expandable block set. This may result in the expandable tool 111 no longer being effective at cutting the earth formation 101. For example, the expandable tool 111 may no longer be able to effectively widen the borehole to a desired diameter, such as a gauge diameter. This may be considered a "ringout" event, or the expandable tool 111 has experienced ringout. A ringout event, or more generally ringout, may be representative of full ringout of the expandable tool 111. In some situations, a ringout event may include a partial ringout. Partial ringout may occur when a portion of the expandable block has worn or broken away with at least a portion of the expandable block retaining the gauge diameter. As used herein, unless otherwise specified, ringout may refer to both full ringout and partial ringout of the expandable block.

During drilling activities, the bit 110 experiences a weight on bit ("WOB"). The WOB may be adjusted by the drilling system 100, by, for example, adjusting the amount of the weight of the drilling tool assembly 104 that is supported by the drill rig 103. The WOB may be measured at any location. For example, the WOB may be measured at a downhole location to determine a downhole WOB ("DWOB"), such as using a downhole WOB sensor 113 at the bit 110 and/or the BHA 106. In some embodiments, the WOB may be measured at a surface location with a surface WOB sensor 119 to determine a surface WOB ("SWOB"). The SWOB may be the suspended weight of the entire drill string, BHA 106, and other downhole tools suspended, including any friction forces, as measured from the surface.

During drilling operations, the drilling system 100 may apply a torque to the drilling tool assembly 104, which may result in a rotation having a rotation per minute ("RPM") to the drilling tool assembly 104. The torque applied to the bit may be the torque on bit (TOB). The TOB may be measured at any location. For example, the TOB may be measured at a downhole TOB sensor 123 to determine a downhole TOB ("DTOB"). The downhole TOB sensor 123 may include one or more sensors located at the bit 110 and/or the BHA 106. In some embodiments, the TOB may be measured as the torque applied to the drill string at a surface location with a surface TOB sensor 127. This may result in a surface TOB ("STOB"). The STOB may be the measured torque applied to the entire drill string 105, BHA 106, and other downhole tools suspended from the surface.

The drilling system 100 may include an ROP sensor 125 for determining the ROP as measured at the surface location (such as by determining the rate at which the drill string 105 is lowered into the wellbore 102). In some embodiments, the surface WOB sensor 119, surface TOB sensor 127, and/or the ROP sensor 125 may be in communication with a processing unit for processing and/or analyzing data observed by the sensors (e.g., the processing unit may receive drilling parameters from one or more sensors). In some embodiments, the processing unit may be located at the surface location. In some embodiments, the processing unit may be located on the BHA 106 downhole.

The expandable tool 111 may operate with a weight on reamer (WOR) and/or a torque on reamer (TOR). The WOR may be the weight supported by the expandable tool 111 during operation. The TOR may be the torque applied by the reamer during operation. In some situations, WOR and/or TOR are inferred based on one or more other measurements in the drilling system 100. For example, WOR may be inferred based on a difference between the SWOB and the DWOB. But the difference between SWOB and DWOB may be influenced by more factors than the WOR, such as friction forces of the drill pipe 108 and/or the BHA 106 with the wellbore wall. In some examples, TOR may be inferred based on a difference between the STOB and the DTOB. But the difference between STOB and DTOB may be influenced by more factors than the TOR, such as friction forces of the drill pipe 108 and/or the BHA 106 with the wellbore wall. The resulting inferred WOR and/or TOR forces may not be representative of the actual WOR and/or TOR experienced by the expandable tool 111.

In some situations, the WOR may be approximately 10% of the SWOB and/or the TOR may be 10% of the STOB. Because the WOR and/or TOR may vary based on downhole drilling conditions, variations in the WOR may not be detected based on the measured SWOB. For example, a reduction in WOR (such as a reduction in the WOR resulting from ringout) may result in a reduction in the total SWOB of approximately 10%. This reduction of the SWOB may be difficult to detect outside of the noise or variability of the SWOB during drilling operations. In some examples, a change in TOR (resulting from ringout) may result in a change in the STOB of approximately 10%. This change in the STOB may be difficult to detect outside of the noise or variability of the STOB during drilling operations.

In accordance with at least one embodiment of the present disclosure, wear on the expandable block may expose one or more brake elements located on the expandable block. The brake elements may be oriented to be inefficient at cutting the earth formation 101, resulting in observable changes in the operation of the drilling system 100. For example, the brake elements may be oriented to generate an increase in the WOR at the expandable tool 111.

The increase in the WOR may be detectable using one or more measurements received at the surface location. For example, the brake elements may be oriented to generate an increase in the WOR, resulting in one or more of the DWOB, surface torque, downhole torque, and/or ROP that are detectable when compared to the noise or variability of the DWOB, surface torque, downhole torque, ROP, and combinations thereof (e.g., greater than the noise). In this manner, when one or more sensor from a sensor suite including the downhole WOB sensor 113, surface WOB sensor 119, downhole TOB sensor 123, surface TOB sensor 127, or ROP sensor 125 generates a signal indicating that the WOR has increased, the drilling operator may determine that the signal is a result of an increase in WOR. This may allow the drilling operator to determine whether the expandable tool 111 has experienced at least partial ringout.

In some embodiments, the brake elements may be oriented to generate a change in the TOR that is detectable when compared to the noise or variability of the DWOB, surface torque, downhole torque, ROP, and combinations thereof (e.g., greater than the noise). In this manner, when one or more sensor from a sensor suite including the downhole WOB sensor 113, surface WOB sensor 119, downhole TOB sensor 123, surface TOB sensor 127, or ROP sensor 125 generates a signal indicating that the TOR has reduced, the drilling operator may determine that the change in STOB is due to a change in TOR caused by ringout. In some embodiments, the brake elements may be oriented to generate a reduction in the ROP that is detectable when compared to the noise or variability of the total ROP (e.g., greater than the noise). In this manner, when the ROP sensor 125 detects that the ROP has changed as measured at the surface location, the drilling operator may determine that the change in ROP is due to a change in ROP caused by ringout.

A ringout detection system may receive the measured drilling parameters from the sensor suite and determine whether ringout has occurred and/or is at risk of occurring. For example, the processing unit may compare one or more measured drilling parameters from the sensor suite to one or more predetermined thresholds to determine whether they correspond to the brake element contacting the wellbore wall. If the processing unit determines that a change in the surface drilling parameters is outside of the normal variation or noise, then the processing unit may determine that the change is due to the brake element contacting the wellbore wall, indicating that ringout has occurred and/or is at risk of occurring.

The drilling system 100 may determine a depth of BHA 106 (including the bit 110 and/or the expandable tool 111) during drilling operations. In some embodiments, the depth of the wellbore may be known and/or inferred based on the number of drill pipes and other downhole tools inserted into the wellbore. In some embodiments, the BHA may include one or more survey tools that may determine a depth of one or more downhole tools, such as the expandable tool 111 and/or the bit 110. The drilling system 100 may associate the depth with the change in WOB, TOB, or ROP. This may allow the drilling operator to determine where the ringout occurred, thereby allowing the drilling operator to mitigate the ringout at the location it occurred.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
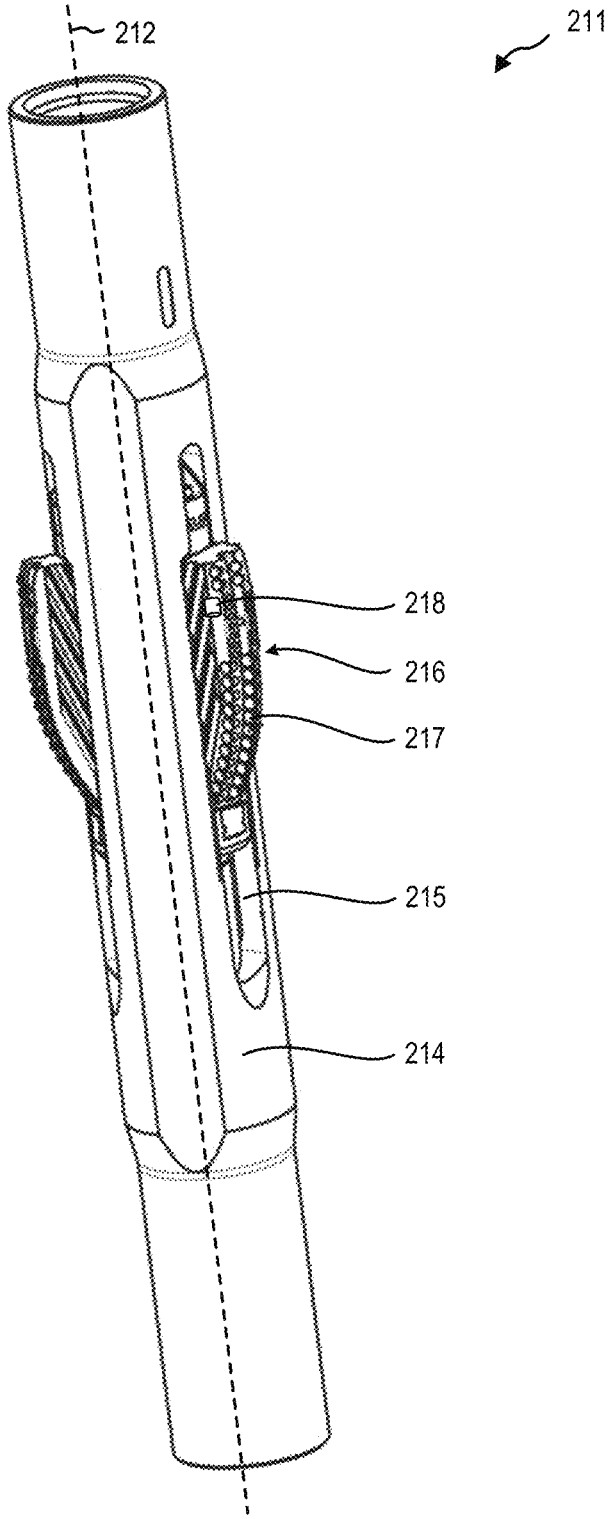
Figure 2:
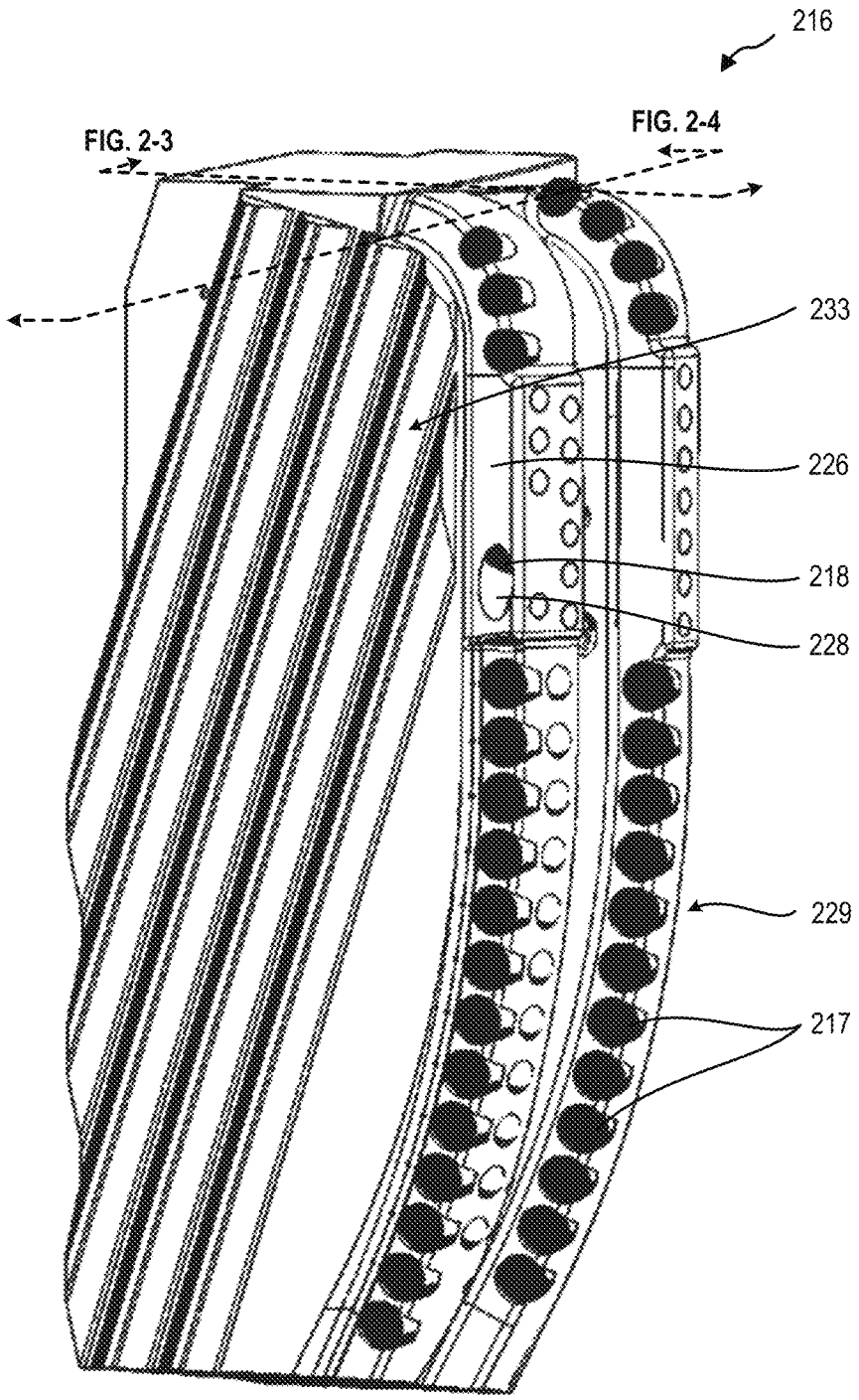

FIG. 2-1 is a perspective view of an expandable tool 211, according to at least one embodiment of the present disclosure. The expandable tool 211 may be coupled to a BHA, drill rig, or other element of a downhole drilling assembly. The expandable tool 211 includes a housing 214. The housing 214 includes a plurality of openings 215 and a plurality of expandable blocks 216. At each opening 215, an expandable block 216 is disposed inside of the housing 214. In some embodiments, the expandable block 216 may be a reamer block. In the expanded configuration shown, the expandable blocks 216 extend out of the housing 214 through the openings 215. In the retracted configuration, the expandable blocks 216 are retracted into the housing 214 and may not extend out of the openings 215, or extend out of the openings 215 less than in the expanded configuration.

Figures 2, 3:
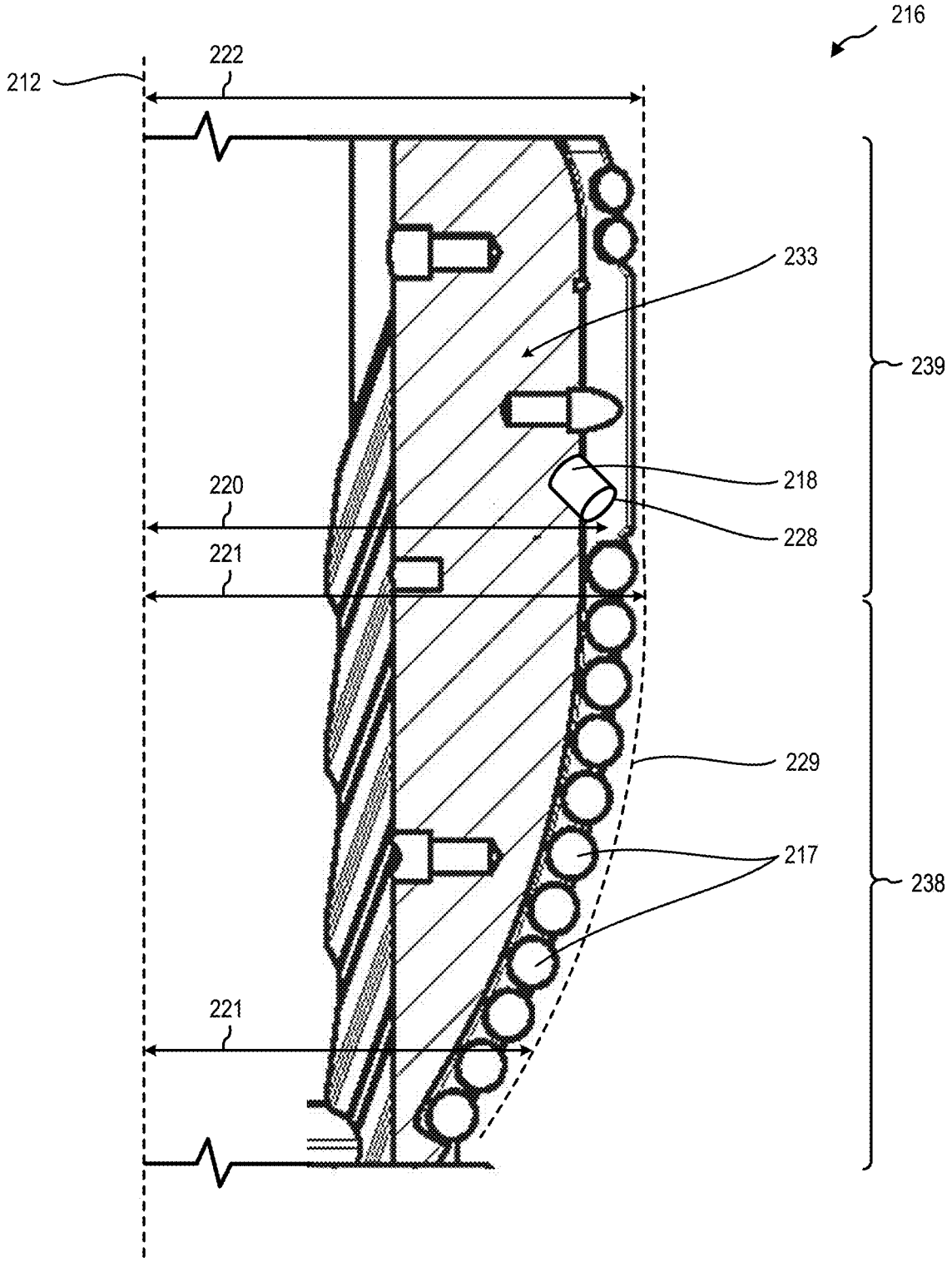

In the embodiment shown in FIG. 2-1 through FIG. 2-3, the expandable tool 211 is an expandable reamer and the expandable block 216 is a reamer block that includes a plurality of cutting elements 217. But it should be understood that the expandable tool 211 may be any type of expandable tool, such as an expandable reamer, an expandable casing cutter, an expandable stabilizer, any other type of expandable tool, and combinations thereof. The expandable block 216 may be any type of expandable block 216, such as an expandable reamer block, an expandable casing cutter block, an expandable stabilizer block, any other type of expandable block, and combinations thereof. While embodiments of the present disclosure may be described with respect to an expandable reamer, it should be understood that such description may be applied to any other type of expandable tool.

In downhole drilling operations, a reamer or other cutting tool may be used to increase the diameter of a wellbore. In some situations, a reamer may be located on the same BHA (e.g., BHA 106 of FIG. 1) as a bit. In this manner, as the bit erodes a formation with a bit diameter, the reamer may follow the bit and erode the formation with a reamer diameter or gauge diameter. This may allow for larger wellbores to be drilled in a single pass or trip downhole. In some situations, a reamer may be tripped into an existing wellbore to increase the diameter of the existing wellbore in a different pass or trip than the bit.

The expandable block 216 may include a brake element 218 embedded in the body of the expandable block 216. As the expandable block 216 and cutting elements 217 wear, a cutting diameter of the expandable tool 211 may become reduced, and the brake element 218 may become exposed to the wellbore wall. The brake element 218 may contact the wellbore wall and change the WOR and/or TOR enough to be noticed by the sensor suite as a change in the WOB and/or TOB. For example, the brake element 218 may be inefficient at cutting the formation, thereby resulting in an increase in the weight supported by the reamer (e.g., the WOR) and/or a decrease in the torque applied to the drilling system. As discussed in further detail herein, the increase in WOR and/or the decrease in torque may be measured and/or inferred using one or more sensors located at the surface and/or downhole at the bit.

FIG. 2-2 is a perspective view of the expandable block 216 of FIG. 2-1. The expandable block 216 may include a plurality of cutting elements 217. The cutting elements 217 may be positioned along a periphery of the expandable block 216 and may define a cutting profile 229. The cutting profile 229 may be curved radially inward at a lower portion, and an upper portion may extend radially outward farther than the lower portion. In other words, the upper portion of the cutting profile 229 may extend a first cutting profile radius and the lower portion of the cutting profile 229 may extend a second cutting profile radius less than the first cutting profile radius. In this way, the cutting profile 229 may define a roughly conical surface when rotated about the axis of the expandable tool. This may allow expandable tool to expand the diameter of the wellbore to a gauge diameter of the expandable tool.

During downhole drilling operations, as the expandable block 216 engages with the earth formation or borehole, the expandable block 216 may experience wear. For example, the plurality of cutting elements 217 and/or the body of the expandable block 216 may chip, spall, or otherwise break. In some instances, one or more of the cutting elements 217 may be removed from the expandable tool 211. In some circumstances, one or more of the cutting elements 217 and/or a periphery of the expandable block 216 may wear down such that the expandable tool 211 experiences ringout, or a reduced diameter. This may reduce the effectiveness of the expandable tool 211. For example, a reduced diameter may result in the expandable tool no longer being able to expand the borehole to the gauge diameter. This can result in delays to a downhole operation and increased costs.

In some situations, as discussed herein, the time and/or depth of the ringout may be undetected because the change in WOB, TOB, or ROP may not noticeably change. This may result in the drilling operator not knowing where to begin re-reaming the wellbore, which may result in further delays and/or sections of the wellbore that were not expanded to the gauge diameter. In some embodiments, knowing the ringout depth may inform whether another reaming operation should be performed or whether the current reamed depth is sufficient for the wellbore.

In accordance with at least one embodiment of the present disclosure, the expandable block 216 may include a brake element 218. The brake element 218 may be located in the expandable block 216 to engage the borehole wall once the expandable block 216 has worn below a threshold level of wear. For example, the brake element 218 may engage the borehole wall when the expandable block 216 has reached a threshold level of wear corresponding to ringout of the expandable tool 211.

When the brake element 218 engages the borehole wall, a drilling operator at the surface may observe a change in behavior of the drilling system. For example, the brake element 218 may engage the borehole wall and cause a change in how the expandable block 216 engages the formation, resulting in an increase in WOR and/or a decrease TOR. This may result in a decrease in the ROP of the drilling system.

In some embodiments, to generate a change in drilling behavior of the expandable block 216, the brake element 218 may be oriented in a passive orientation. A passive orientation may be an orientation that does not cut rock effectively. For example, a passive orientation may use more force to degrade the formation than the cutting elements 217. In some examples, a passive orientation may slide along the formation, resulting in a decrease in the torque. In some example, a passive orientation may at least partially support the weight of the drilling system, resulting in an increase in WOR and a decrease in DWOB. The SWOB may remain the same. For example, an increase in the WOR may not change the hookload of the drilling system, and may change the distribution of weight supported by the reamer and/or the bit. In some embodiments, this may result in a reduction of the ROP of the drilling system because the brake element 218 is reducing the cutting action of the reamer and/or the bit.

In some embodiments, the expandable block 216 may include multiple brake elements 218. For example, the expandable block 216 may include 2, 3, 4, 5, 6, 7, 8, 9, 10, or more brake elements 218. In some embodiments, two or more brake elements 218 may be located at the same longitudinal location and/or at the same profile radius on the body of the expandable block 216. This may correspond to the two or more brake elements engaging the borehole wall at substantially the same time, or after substantially the same amount of wear of the expandable block 216. This may help to increase the signal to the surface when the brake elements 218 engage the surface.

In some embodiments, different brake elements 218 may be located at different longitudinal locations along the expandable block 216. For example, a first portion 228 of the plurality of brake elements 218 may be located at a first longitudinal location 226 along the expandable block 216 and a second portion of the plurality of the brake element 218 may be located at a second longitudinal location along the expandable block 216. The first longitudinal location 226 may correspond to a first portion of the expandable block 216 or a first portion of the cutting profile 229, and the second longitudinal location may correspond to a second portion of the expandable block 216 or a second portion of the cutting profile 229. In other words, the second longitudinal location may be positioned a longitudinal distance from the first longitudinal location. The first longitudinal location may be downhole of the second longitudinal location. In this way, the first portion 228 of the plurality of the brake element 218 may engage the borehole wall and indicate wear of the first portion of the expandable block 216 or wear of the first portion of the cutting profile 229, and the second portion of the plurality of the cutting element 217 may engage the borehole wall and indicate wear of the second portion of the expandable block 216 or wear of the second portion of the cutting profile 229.

In some embodiments, different brake elements of a plurality of the brake element 218 may be located at different radial locations along the expandable block 216. For example, a first portion of the plurality of the brake element 218 may be connected to the expandable block 216 and extend to a first brake radius, and a second portion of the plurality of the brake element 218 may be connected to the expandable block 216 and extend to a second brake radius. The first brake radius may correspond to a first diameter or a first level of ringout of the expandable block 216, and the second brake radius may correspond to a second diameter or a second level of ringout of the expandable block 216. In this way, the first portion 228 of the plurality of the brake element 218 may engage the borehole wall and indicate ringout or wear of the expandable block 216 to the first diameter, and the second portion of the plurality of the brake element 218 may engage the borehole wall and indicate ringout or wear of the expandable block 216 to the second diameter. In this way, the expandable block 216 may include a plurality of the brake element 218, and at least some of the plurality of the brake element 218 may be positioned in different longitudinal and/or radial locations corresponding to the different brake elements engaging the borehole wall and indicating different forms or levels of wear of the geometry of the expandable block 216.

The brake element 218 may be located radially inward from the cutting profile 229 of the expandable block 216. In some embodiments, the brake element 218 may not engage the borehole wall while the cutting elements 217 radially outward from the brake element 218 are engaging the borehole wall. In some embodiments, the brake element 218 may be positioned such that it does not engage the borehole wall while the expandable tool 211 is still effectively expanding the borehole. For example, the brake element 218 may be positioned such that it engages the borehole wall once the expandable block 216 has worn to a first reduced diameter. In this way, the brake element 218 may be positioned to engage the borehole wall when the expandable block 216 has worn to the first reduced diameter, indicating that the expandable block 216 is no longer widening the borehole to the gauge diameter or is at a risk to no longer widen the borehole to the gauge diameter. In some examples, a second brake element 218 may be positioned to engage the borehole wall once the expandable block 216 has been worn to a second reduced diameter less than the first reduced diameter. In this manner, the brake element 218 may be positioned to engage the borehole wall when the expandable block 216 has been worn to the second reduced diameter, indicating that the expandable block 216 has undergone a more advanced degree of ringout or wear at the location of the brake element 218.

FIG. 2-3 is a side cross-sectional view of the expandable block 216 of FIG. 2-1. The expandable block 216 may rotate around an axis of rotation 212 of the expandable tool 211. The brake element 218 may be embedded in the body 233 of the expandable block 216 and may be positioned at a brake radius 220. The brake radius 220 may be the furthest extent of the brake element 218 from the axis of rotation 212. A profile radius 221 may be the radial distance of the cutting profile 229 corresponding to a longitudinal location of the brake element 218. In other words, the profile radius 221 may vary depending on a longitudinal location of the brake element 218. For example, as shown in FIG. 2-3, the brake element 218 is located longitudinally at a gauge portion 239 of the cutting profile 229. The gauge portion 239 may correspond to a portion of the cutting profile 229 where the profile radius 221 extends to the gauge diameter of the expandable tool 211. In another example, the brake element 218 may be located longitudinally at a nose portion 238 of the cutting profile 229. The nose portion 238 may correspond to a portion of the cutting profile 229 where the profile radius 221 extends less than the profile radius 221 of the gauge portion 239 or less than the gauge diameter of the expandable tool 211. The profile radius 221 of the nose portion may taper toward the axis of rotation 212 as the cutting profile 229 extends longitudinally down the expandable block 216. In other words, the nose portion 238 may extend radially inward toward the axis of rotation 212.

The brake radius 220 may be less than the profile radius 221. For example, the brake element 218 may be located radially inward from the cutting elements 217 that correspond to the longitudinal location of the brake element 218 along the expandable block 216. In this manner, the brake element 218 may be radially positioned such that it is not initially exposed to the borehole wall when the expandable tool 211 is being used to widen the borehole, and when the cutting elements 217 are engaging the borehole wall. The brake element 218 may become exposed to and engage the borehole wall when the expandable block 216 experiences a level of wear. In this way the brake element 218 engaging the borehole wall may correspond to ringout of the expandable tool 211.

A gauge radius 222 of the expandable tool 211 may correspond to a maximum radial distance of the profile radius 221 of the cutting profile 229. The gauge radius 222 may also correspond to a desired diameter, or gauge diameter of the borehole. In some embodiments, the brake radius 220 may be less than a gauge radius 222 of the expandable tool 211 by a ringout distance. In some embodiments, the ringout distance may be in a range having an upper value, a lower value, or upper and lower values including any of 5 mm, 1 cm, 2 cm, 3 cm, 4 cm, 5 cm, 6 cm, 8 cm, 10 cm, 12 cm, or any value therebetween. For example, the ringout distance may be greater than 5 mm. In another example, the ringout distance may be less than 12 cm. In yet other examples, the ringout distance may be any value in a range between 5 mm and 12 cm. In some embodiments, it may be critical that the ringout distance is between 1 mm and 3 cm to allow the drilling operator to identify when ringout has occurred. In this way, the brake element 218 may engage the borehole wall and indicate that the expandable tool 211 is no longer widening the borehole to a gauge diameter and that ringout of the expandable tool 211 has begun.

In some embodiments, multiple brake elements 218 may be embedded in the expandable block 216. At least a portion of the brake elements 218 may be positioned and configured according to the various embodiments discussed above. In this way, different brake elements 218 may be configured to engage the borehole wall corresponding to different levels of wear of the expandable block 216. For example, a first portion of the brake elements 218 may be positioned to indicate a first degree of ringout, and a second portion of the plurality of brake elements 218 may be positioned to indicate a second degree of wear more severe than that of the first degree of ringout. In this way, multiple brake elements 218 may indicate the degree of ringout of the expandable tool 211.

Figures 2, 3, 4:
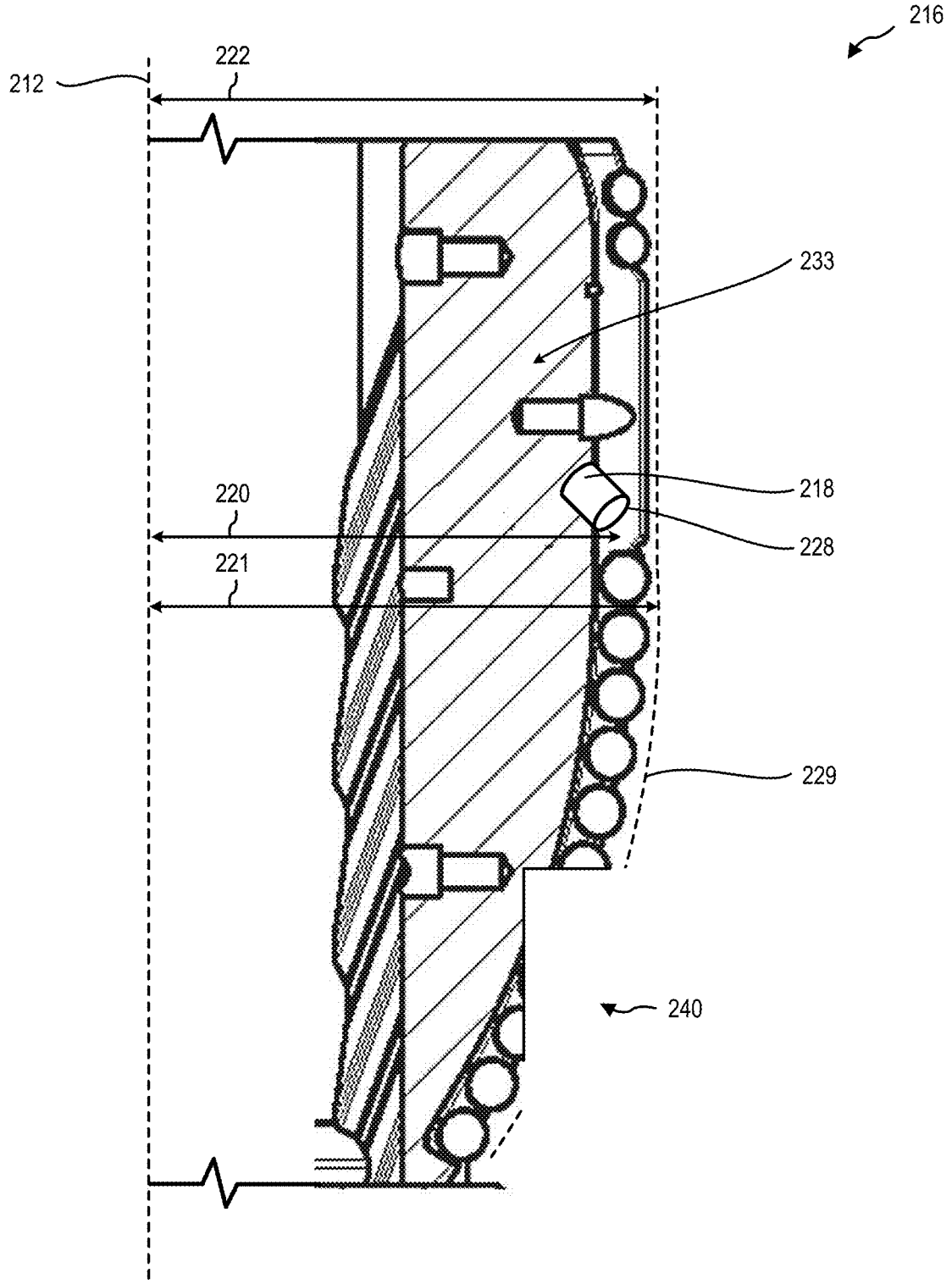

FIG. 2-4 is a schematic cross-sectional view of the expandable block 216 of FIG. 2-3 experiencing partial ringout, or experiencing wear that may lead to ringout of the expandable block 216. As may be seen, the expandable block 216 has experienced wear, resulting in a worn portion 240 of the body 233. The worn portion 240 may be a portion of the body 233 that has had all or a portion of the cutting elements 217 broken or fallen out of the cutting element pockets, and the body 233 has started to wear away from the formation.

In FIG. 2-5, the worn portion 240 of the body 233 has expanded along the length of the expandable block 216 to the brake element 218. When the worn portion 240 reaches the brake element 218, the brake element 218 may engage the formation. As discussed herein, the brake element 218 may not efficiently engage the formation, thereby increasing the weight supported by the expandable block 216. This may result in a decrease in the DWOB, a decrease in the STOB and DTOB, and a decrease in the ROP of the drilling system. This may allow the ringout detection system to detect when ringout has extended to the brake element 218, as shown in FIG. 2-5. In this manner, the ringout detection system may determine that ringout of the expandable block 216 has happened or is in the process of happening.

In FIG. 2-6, the worn portion 240 of the body 233 has expanded along the entire length of the expandable block 216. For example, the brake element 218 has worn away, resulting in the rest of the body 233 wearing away. This may result in total ringout of the expandable block 216. At this level of wear, the expandable block 216 is no longer supporting a significant amount of weight or causing a significant amount of torque on the drilling system. This may result in an increase in the DWOB, STOB, DTOB, and ROP. The increase in ROP may be a result of the depth of the wellbore increasing, without an associated increase in the depth of the reamed section.

FIG. 3 is a representation of a ringout detection system 342, according to at least one embodiment of the present disclosure. Each of the components of the ringout detection system 342 can include software, hardware, or both. For example, the components can include one or more instructions stored on a computer-readable storage medium and executable by processors of one or more computing devices, such as a client device or server device. When executed by the one or more processors, the computer-executable instructions of the ringout detection system 342 can cause the computing device(s) to perform the methods described herein. Alternatively, the components can include hardware, such as a special-purpose processing device to perform a certain function or group of functions. Alternatively, the components of the ringout detection system 342 can include a combination of computer-executable instructions and hardware.

Furthermore, the components of the ringout detection system 342 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The ringout detection system 342 includes a sensor suite including one or more sensors 344. The sensors 344 may include a SWOB sensor 319, a surface torque sensor 327, a DWOB sensor 313, a downhole torque sensor 323, an ROP sensor 325, a bit location sensor 346, any other sensor, and combinations thereof. The sensors 344 may provide an indication of the status of the drilling system. For example, the SWOB sensor 319 may measure the hookload at the hook and provide an indication of the weight of the drill string that is supported by the hook. When the drill string, BHA, and bit are suspended off the bottom of the wellbore, the WOB may be inferred as the difference between the total suspended weight when the bit is on-bottom and off-bottom.

In some examples, the surface torque sensor 327 may measure torque applied to the drill string at the rotary table or other portion of the surface drilling system, and may be an indication of the torque applied to the drilling system by the bit, the reamer, and friction forces of the drill string with the wellbore wall.

The DWOB sensor 313 may directly measure WOB experienced at the bit. For example, the DWOB sensor 313 may include a sensor at the bit, a portion of the BHA close to the bit, any portion of the BHA, and combinations thereof. The DWOB sensor 313 may measure the force applied to the bit as the DWOB.

The downhole torque sensor 323 may directly measure TOB experienced at the bit. For example, the downhole torque sensor 323 may include a sensor at the bit, a portion of the BHA close to the bit, any portion of the BHA, and combinations thereof. The downhole torque sensor 323 may measure the torque experienced as the DTOB.

The bit location sensor 346 may measure the location and/or trajectory of the bit. For example, the bit location sensor 346 may include a survey tool to measure the depth of the bit. In some examples, the bit location sensor 346 may include a survey tool to measure the trajectory (e.g., azimuth and/or inclination) of the bit. In some embodiments, the bit location sensor 346 may include a depth sensor at the surface that tracks how many lengths of drill pipe and tools have been installed to determine the depth of the bit.

The sensors 344 may include an ROP sensor 325. The ROP sensor 325 may measure the rate at which new drill pipe enters the wellbore, which may be an indication of the rate at which the depth of the wellbore is advancing.

The downhole sensors, such as the DWOB sensor 313, the downhole torque sensor 323, the bit location sensor 346, other downhole sensors, and combinations thereof, may transmit the downhole drilling parameters to the surface. The downhole sensors may transmit the downhole drilling parameters to the surface with any transmission mechanism, such as mud pulse telemetry, wired pipe transmission, wireline transmission, wireless electromagnetic transmission, any other transmission mechanism, and combinations thereof. The downhole drilling parameters may be received at the surface at a sensor receiver 348. The sensor receiver 348 may be configured to receive the downhole drilling parameters in any transmission mechanism. In some embodiments, the downhole sensors record the downhole drilling parameters for retrieval after the downhole sensors are resurfaced.

The surface sensors, such as the SWOB sensor 319, the surface torque sensor 327, the ROP sensor 325, any other surface sensor, and combinations thereof, may collect drilling parameters at the surface. The sensor receiver 348 may receive the surface measurements from the surface sensors.

The ringout detection system 342 may include a ringout identifier 350. The ringout identifier 350 may analyze the measured drilling parameters received at the sensor receiver 348 to determine whether ringout has occurred and/or whether there is a risk of ringout occurring. For example, the ringout identifier 350 may analyze patterns in the measured drilling parameters to determine whether a change in the measurements has reached or exceeded a threshold change. If the ringout identifier 350 identifies that the change in the measured drilling parameters has reached or exceeded a threshold, then the ringout identifier 350 may identify that ringout has occurred.

In some embodiments, the ringout identifier 350 may identify that ringout has occurred based on a comparison between two or more values of the measured drilling parameters received by the sensor receiver 348. For example, the ringout identifier 350 may compare the SWOB determined using the SWOB sensor 319 to one or more of the STOB determined using the surface torque sensor 327, the DWOB determined using the DWOB sensor 313, the downhole torque determined using the downhole torque sensor 323, any other value, and combinations thereof. In some embodiments, the ringout identifier 350 may use the ROP determined using the ROP sensor 325 to validate whether ringout has occurred.

As a specific, non-limiting example, the ringout identifier 350 may compare SWOB to DWOB to determine whether ringout has occurred and/or is likely to occur. If the SWOB has remained constant (e.g., the SWOB is consistent over a period) but the DWOB has decreased, the ringout identifier 350 may determine that ringout has occurred and/or is likely to occur. For example, the ringout identifier 350 may determine that a passive cutting element, such as a brake, button, depth of cut limiter, or other passive cutting element, has engaged the formation. The engagement of the formation by the passive cutting element may result in a decrease in the DWOB because the passive cutting element may cause the reamer to support at least a portion of the total weight of the drilling string, thereby decreasing the DWOB. The SWOB may remain the same or approximately the same because the total weight supported by the reamer and the bit may remain the same or approximately the same. In this manner, when the ringout identifier 350 identifies that the DWOB has decreased while the SWOB remains approximately constant, the ringout identifier 350 may determine that ringout has occurred and/or is likely to occur.

In some embodiments, the ringout identifier 350 may determine that ringout has occurred and/or is likely to occur by comparing the measured drilling parameters received by the sensor receiver 348 over a measurement period. For example, if the change in measured drilling parameters occurs and/or remains steady over the measurement period, then the change may be attributed to ringout. In some embodiments, the measurement period may be in a range having an upper value, a lower value, or upper and lower values including any of 1 s, 5 s, 10 s, 20 s, 30 s, 45 s, 1 min., 1.5 min., 2 min., 5 min., 10 min., 20 min., 30 min., 1 hour, or any value therebetween. For example, the measurement period may be greater than 1 s. In another example, the measurement period may be less than 1 hour. In yet other examples, the measurement period may be any value in a range between 1 s and 1 hour. In some embodiments, it may be critical that the measurement period is between 5 s and 1 min. to identify ringout using the measured drilling parameters.

In some embodiments, the ringout identifier 350 may determine that ringout has occurred and/or is likely to occur by comparing a measurement quantity of measured drilling parameters. In some embodiments, the measurement quantity may be in a range having an upper value, a lower value, or upper and lower values including any of 1, 2, 3, 4, 5, 6, 7, 8, 9, 10, 15, 20, 30, 40, 50, 75, 100, 250, 500, 1,000, 5,000, 10,000, 50,000, 100,000, or any value therebetween. For example, the measurement quantity may be greater than 1. In another example, the measurement quantity may be less than 100,000. In yet other examples, the measurement quantity may be any value in a range between 1 and 100,000. In some embodiments, it may be critical that the measurement quantity is greater than 10 to identify ringout using the measured drilling parameters.

In some embodiments, the ringout identifier 350 may compare the drilling parameters received by the sensor receiver 348 to drilling parameters previously received. For example, the ringout identifier 350 may compare the drilling parameters to a previously recorded average measurement. In some examples, the ringout identifier 350 may compare the drilling parameters to a rolling average collected to a measurement period and/or a measurement quantity of measured drilling parameters. In some embodiments, the ringout identifier 350 may identify changes in the measured drilling parameters by identifying a change in a rolling average over the measurement period and/or the measurement quantity of measured drilling parameters. In some embodiments, a drilling parameter may be measured at approximately 1 Hz, 5 Hz, 10 Hz, 20 Hz, 60 Hz, 100 Hz, or 200 Hz, or more during a measurement period. For example, during a 30 minute measurement period, a drilling parameter may be measured 1800 times at 1 Hz or 108,000 times at 60 Hz. Due to a variety of factors including but not limited to the sensors, vibration, drill string interactions with the formation, and fluid flow dynamics, variations in the measured drilling parameters may be recorded. The ringout identifier 350 may compare the drilling parameters to previously measured and/or expected parameters to reduce or eliminate the effect of outliers, noise, and anomalies in the drilling parameters on a ringout determination.

In some embodiments, the ringout identifier 350 may determine that the DWOB has changed relative to the SWOB. The ringout identifier 350 may generate a WOB ratio (e.g., DWOB divided by SWOB). If the WOB ratio decrease meets or exceeds a WOB ratio threshold (e.g., a percent change in the WOB ratio), then the ringout identifier 350 may determine that ringout has occurred and/or is likely to occur. In some embodiments, the WOB ratio threshold may be in a range having an upper value, a lower value, or upper and lower values including any of 0%, 10%, 20%, 30%, 40%, 50%, 60%, 70%, 80%, 90%, 100%, or any value therebetween. For example, the WOB ratio threshold may be greater than 0%. In another example, the WOB ratio threshold may be less than 100%. In yet other examples, the WOB ratio threshold may be any value in a range between 0% and 100%. In some embodiments, it may be critical that the WOB ratio threshold is greater than 50% to determine the signal of the WOB ratio threshold from the noise of the variability in measurements of the SWOB and DWOB. It may be desirable during drilling operations with engagement of a reamer and a drill bit with the formation for the WOB ratio to be between 75% to 95%, such as between 80% to 90%. When drilling homogenous formation sections, the WOB ratio may be expected to be steady without fluctuations outside of 75% to 95%. However, upon entering new formation sections, fluctuations to the WOB ratio may be encountered outside of 75% to 95%. Accordingly, the ringout identifier 350 may interpret patterns of the WOB ratio to discern whether changes in the formation or ringout are causing the WOB ratio to be outside the WOB ratio threshold. For example, a short duration of time or depth that the WOB ratio is outside the WOB ratio threshold may suggest a change in formation, particularly when drilling through shallow formation layers of different properties. A rapid and persistent reduction in the WOB ratio outside the WOB ratio threshold to 50% or less for a time period (e.g., approximately 5 to 30 seconds) may indicate a ringout, particularly if the WOB ratio later exceeds recent WOB ratio values after continued drilling ahead.

In some embodiments, the ringout identifier 350 may determine that ringout has occurred and/or is likely to occur by comparing the STOB to the SWOB. The ringout identifier 350 may generate a surface torque ratio (e.g., surface torque divided by SWOB). As may be understood, the surface torque and the SWOB may have different units, and the resulting surface torque ratio may not be dimensionless. Nevertheless, the surface torque ratio may be calculated and determined for referential purposes. In some embodiments, the surface torque ratio and the surface torque threshold may be compared to a baseline value established previously in the same run and/or from a run in an offset wellbore. If the surface torque ratio decrease meets or exceeds a surface torque ratio threshold (e.g., a percent change in the surface torque ratio), then the ringout identifier 350 may determine that ringout has occurred and/or is likely to occur. In some embodiments, the surface torque ratio threshold may be in a range having an upper value, a lower value, or upper and lower values including any of 0%, 10%, 20%, 30%, 40%, 50%, 60%, 70%, 80%, 90%, 100%, or any value therebetween. For example, the surface torque ratio threshold may be greater than 0%. In another example, the surface torque ratio threshold may be less than 100%. In yet other examples, the surface torque ratio threshold may be any value in a range between 0% and 100%. In some embodiments, it may be critical that the surface torque ratio threshold is greater than 50% to determine the signal of the surface torque ratio threshold from the noise of the variability in measurements of the SWOB and surface torque. It may be desirable during drilling operations with engagement of a reamer and a drill bit with the formation for the surface torque to be at approximately a steady value. When ringout begins, the surface torque may reduce, such as by 10% or more from the previously steady value. Upon engagement of a brake element of a reamer prior to a ringout of the reamer, the surface torque may drop significantly to approximately 50% or less of the previously steady value. After ringout of the reamer occurs, the surface torque may increase to approximately the previously steady value before ringout occurred. The surface torque ratio threshold may be based on the steady value of the surface torque during engagement of the reamer and drill bit with the formation.

In some embodiments, the ringout identifier 350 may determine that ringout has occurred and/or is likely to occur by comparing the DTOB to the SWOB. The ringout identifier 350 may generate a downhole torque ratio (e.g., downhole torque divided by SWOB). As may be understood, the downhole torque and the SWOB may have different units, and the resulting downhole torque ratio may not be dimensionless. Nevertheless, the downhole torque ratio may be calculated and determined for referential purposes. In some embodiments, the downhole torque ratio and the downhole torque threshold may be compared to a baseline value established previously in the same run and/or from a run in an offset wellbore. If the downhole torque ratio decrease meets or exceeds a downhole torque ratio threshold (e.g., a percent change in the downhole torque ratio), then the ringout identifier 350 may determine that ringout has occurred and/or is likely to occur. In some embodiments, the downhole torque ratio threshold may be in a range having an upper value, a lower value, or upper and lower values including any of 0%, 10%, 20%, 30%, 40%, 50%, 60%, 70%, 80%, 90%, 100%, or any value therebetween. For example, the downhole torque ratio threshold may be greater than 0%. In another example, the downhole torque ratio threshold may be less than 100%. In yet other examples, the downhole torque ratio threshold may be any value in a range between 0% and 100%. In some embodiments, it may be critical that the downhole torque ratio threshold is greater than 50% to determine the signal of the surface torque ratio threshold from the noise of the variability in measurements of the SWOB and surface torque.

In some embodiments, the ringout identifier 350 may determine that ringout has occurred and/or is likely to occur by comparing a measured DTOR to the SWOB. The ringout identifier 350 may generate a reamer torque ratio (e.g., DTOR divided by SWOB). As may be understood, the DTOR and the SWOB may have different units, and the resulting reamer torque ratio may not be dimensionless. Nevertheless, the reamer torque ratio may be calculated and determined for referential purposes. In some embodiments, the reamer torque ratio and the reamer torque threshold may be compared to a baseline value established previously in the same run and/or from a run in an offset wellbore. If the reamer torque ratio decrease meets or exceeds a reamer torque ratio threshold (e.g., a percent change in the reamer torque ratio), then the ringout identifier 350 may determine that ringout has occurred and/or is likely to occur. In some embodiments, the reamer torque ratio threshold may be in a range having an upper value, a lower value, or upper and lower values including any of 0%, 10%, 20%, 30%, 40%, 50%, 60%, 70%, 80%, 90%, 100%, or any value therebetween. For example, the reamer torque ratio threshold may be greater than 10%. In another example, the reamer torque ratio threshold may be less than 100%. In yet other examples, the reamer torque ratio threshold may be any value in a range between 10% and 100%. In some embodiments, it may be critical that the reamer torque ratio threshold is greater than 50% to determine the signal of the reamer torque ratio threshold from the noise of the variability in measurements of the SWOB and DTOR.

In some embodiments, the ringout identifier 350 may determine that ringout has occurred and/or is likely to occur by comparing a measured DWOR to the SWOB. The ringout identifier 350 may generate a DWOR ratio (e.g., DWOR divided by SWOB). As may be understood, the DWOR and the SWOB may have different units, and the resulting DWOR ratio may not be dimensionless. Nevertheless, the DWOR ratio may be calculated and determined for referential purposes. In some embodiments, the DWOR ratio and the DWOR ratio threshold may be compared to a baseline value established previously in the same run and/or from a run in an offset wellbore. If the DWOR ratio decrease meets or exceeds a DWOR ratio threshold (e.g., a percent change in the DWOR ratio), then the ringout identifier 350 may determine that ringout has occurred and/or is likely to occur. In some embodiments, the DWOR ratio threshold may be in a range having an upper value, a lower value, or upper and lower values including any of 0%, 10%, 20%, 30%, 40%, 50%, 60%, 70%, 80%, 90%, 100%, or any value therebetween. For example, the DWOR ratio threshold may be greater than 10%. In another example, the DWOR ratio threshold may be less than 100%. In yet other examples, the DWOR ratio threshold may be any value in a range between 10% and 100%. In some embodiments, it may be critical that the DWOR ratio threshold is greater than 50% to determine the signal of the DWOR ratio threshold from the noise of the variability in measurements of the SWOB and DWOR.

In some embodiments, the drilling operator may utilize the ROP to verify that ringout has occurred and/or is likely to occur. For example, when the ringout identifier 350 identifies that the WOB ratio, surface torque ratio, downhole torque ratio, or other ratio has decreased or otherwise indicated ringout, the ringout identifier 350 may verify ringout by determining whether the ROP stayed the same or decreased during that period. If the ROP decreased, then that may indicate that the brake element supported at least a portion of the drilling system, further verifying that ringout has occurred and/or is occurring. In some embodiments, the WOB ratio, surface torque ratio, downhole torque ratio, or other ratio may return to average or prior values. If the ROP returns to the prior values and/or increases, then the ringout identifier 350 may determine that ringout has occurred and the reamer is no longer widening the wellbore.

In some embodiments, the ringout identifier 350 may determine whether ringout has occurred and/or is likely to occur based on a mechanical specific energy (MSE) of the drilling system. The MSE may be determined by Eq. (1):

$$MSE = \frac{WOB}{A_b} + \frac{120\pi * RPM * TOB}{A_b * ROP} \quad \text{Eq. (1)}$$

where $A_b$ is the area of the bit. In some embodiments, the MSE may help to amplify complementary changes to the drilling parameters. For example, the MSE may help to identify the interaction between WOB and TOB for a particular bit area. A change in the MSE may indicate that ringout has occurred. For example, using SWOB and STOB in Eq. 1, a decrease in the TOB may result in a decrease in the MSE. The decrease in the MSE may be associated with ringout.

In some embodiments, the ringout identifier may determine whether ringout has occurred and/or is likely to occur based on a reamer MSE, as determined by Eq. (2):

$$MSE = \frac{WOR}{A_r} + \frac{120\pi * RPM * TOR}{A_r * ROP} \quad \text{Eq. (1)}$$

where $A_r$ is the area of the reamer. In some embodiments, the reamer MSE may help to amplify complementary changes to the drilling parameters. For example, the MSE may help to identify the interaction between WOR and TOR for a particular bit area. A change in the reamer MSE may indicate that ringout has occurred. In some embodiments, any other ratio, formula, or relationship between WOB (both surface and downhole), WOR, surface torque, downhole torque, TOR, rock strength, hole size, any other drilling parameter, and combinations thereof, may be utilized to identify ringout.

In some embodiments, the ringout detection system may integrate other elements of the drilling system to determine ringout. For example, the sensor receiver 348 may receive formation information from a drill plan and/or from sensors at the bit. The formation information may include rock strength, rock type, confining pressure, any other formation information, and combinations thereof. The ringout identifier 350 may determine ringout using the formation information. For example, the ringout identifier 350 may identify a reduction in ROP and associate the reduction in the ROP with a change information, thereby reducing the likelihood of ringout. In some embodiments, the ringout detection system may integrate portions of the drill plan. For example, the ringout detection system 342 may integrate drill bit type, drill bit diameter, reamer type, reamer diameter, and so forth regarding the drilling system. The details of the drilling system from the drill plan may impact one or more formulas used to identify ringout, such as bit MSE, reamer MSE, a confidence coefficient based on rock inhomogeneity or reamer diameter, any other formulas or coefficients, and combinations thereof.

In some embodiments, as discussed herein, the ringout detection system 342 may determine that a passive element has engaged the formation based on the drilling parameter measurements. In some embodiments, the ringout detection system 342 may distinguish between different types of passive elements based on a magnitude of the drilling parameter measurements and/or a magnitude of the change in drilling parameter measurements or a magnitude of the change in the ratios or comparative drilling parameter measurements. For example, the ringout detection system 342 may determine that the passive element is a brake element.

The ringout detection system 342 may include a drilling integrator 352. The drilling integrator 352 may help to integrate the drilling plan with the determination of ringout. For example, the drilling integrator 352 may utilize the bit depth, azimuth, inclination, and/or any other bit location information from the bit location sensor 346 to identify where ringout occurred. This may allow the drilling operator to take corrective action at the ringout location. For example, the drilling operator may insert a new reamer into the wellbore and resume reaming at the ringout location. In some examples, the drilling operator may actuate a second reamer to continue reaming at the ringout location.

In some embodiments, the ringout identifier 350 may identify ringout while the drilling system is performing drilling activities. For example, the ringout identifier 350 may identify ringout based on live measurements received at the sensor receiver 348 from the sensors 344. The ringout identifier 350 may monitor the drilling parameters and determine whether ringout has occurred during drilling activities. When the ringout identifier 350 identifies ringout, the drilling integrator 352 may provide an alert to the drilling operator. In some embodiments, the drilling integrator 352 may automatically take corrective action.

FIG. 4 is a schematic representation of a drilling parameter plot 454, according to at least one embodiment of the present disclosure. The drilling parameter plot 454 include drilling parameter measurements on the x-axis (e.g., horizontal axis) and time or depth on the y-axis (e.g., vertical axis). The drilling parameter plot 454 shown includes a SWOB plot 456 and a DWOB plot 458. The SWOB plot 456 may include measurements of SWOB taken by a SWOB sensor at the surface. The DWOB plot 458 may include measurements of DWOB taken at a DWOB sensor at the bit.

The drilling parameter plot 454 may include a first measurement period 460. The first measurement period 460 may include measurements taken while the reamer is engaging the formation. As may be seen, the SWOB measurements in the SWOB plot 456 and the DWOB measurements in the DWOB plot 458 may be relatively constant (e.g., the SWOB and DWOB are consistent over the first measurement period 460). Further, the WOB ratio between DWOB and the SWOB in the SWOB plot 456 and DWOB plot 458 may be relatively constant (e.g., the WOB ratio is consistent over the first measurement period 460).

In a second measurement period 462, the measurements in the DWOB plot 458 may be significantly decreased while the SWOB has stayed the same or approximately the same. This may result in a decrease in the WOB ratio. In some embodiments, a ringout detection system may identify the decrease in the DWOB with respect to the SWOB as an indication of ringout. In some embodiments, the ringout detection system may identify that a passive cutting element (e.g., a cutting element that is inefficient at cutting the formation) of the reamer has engaged the formation, resulting in a decrease in the WOB. In some embodiments, the ringout detection system may identify that a brake element of the reamer has engaged the formation.

The drilling parameter plot 454 includes a third measurement period 464. In the third measurement period 464, the DWOB has increased. This may indicate that a complete ringout has occurred and that the reamer is no longer supporting any of the weight of the drilling system. In some embodiments, the DWOB in the third measurement period 464 may be higher than the DWOB in the second measurement period 462 and the first measurement period 460. A higher DWOB in the third measurement period 464 and the first measurement period 460 may indicate that the bit has received the weight of the drilling system, including the weight previously supported by the reamer.

In some embodiments, the ringout detection system may identify ringout only using the drilling parameter measurements in the second measurement period 462. For example, the ringout detection system may identify ringout based solely on the comparison between the DWOB and the SWOB in the second measurement period 462.

In some embodiments, the ringout detection system may identify ringout using a pattern of measurements across two or more of the first measurement period 460, the second measurement period 462, and the third measurement period 464. For example, the ringout detection system may identify the pattern of change in DWOB and/or the WOB ratio between the first measurement period 460 and the second measurement period 462. Based on the pattern of change in DWOB and/or the WOB ratio between the first measurement period 460 and the second measurement period 462, the ringout detection system may identify ringout. In some examples, the ringout detection system may identify the pattern of change in DWOB and/or the WOB ratio between the second measurement period 462 and the third measurement period 464. Based on the pattern of change in DWOB and/or the WOB ratio between the second measurement period 462 and the third measurement period 464, the ringout detection system may determine that ringout has occurred. In some examples, the ringout detection system may determine that ringout has occurred based on the pattern of change between the first measurement period 460, the second measurement period 462, and the third measurement period 464.

In some embodiments, the DWOB plot 458 may include a transition period 466 between the first measurement period 460 and the second measurement period 462. The transition period 466 may include a rate of change in the DWOB and/or a rate of change in the WOB ratio. In some embodiments, the transition period 466 may include a pattern of WOB readings. In some embodiments, the ringout detection system may determine that ringout is occurring based on the pattern of measurements in the transition period 466. In some embodiments, the ringout detection system may determine that ringout has occurred and/or is occurring based on the pattern of DWOB measurements in the transition period 466 followed by the values and/or patterns of the DWOB measurements in the second measurement period 462.

In some embodiments, the ringout detection system may determine ringout based on the DWOB measurements from the DWOB plot 458 alone. For example, the pattern of change in the DWOB measurements may indicate whether ringout has occurred. In some examples, the magnitude of change in the DWOB measurements may indicate that ringout has occurred. The ringout detection system may identify the changes in the DWOB across the first measurement period 460, the transition period 466, the second measurement period 462, the third measurement period 464, and combinations thereof.

Figures 2, 3, 4, 5:
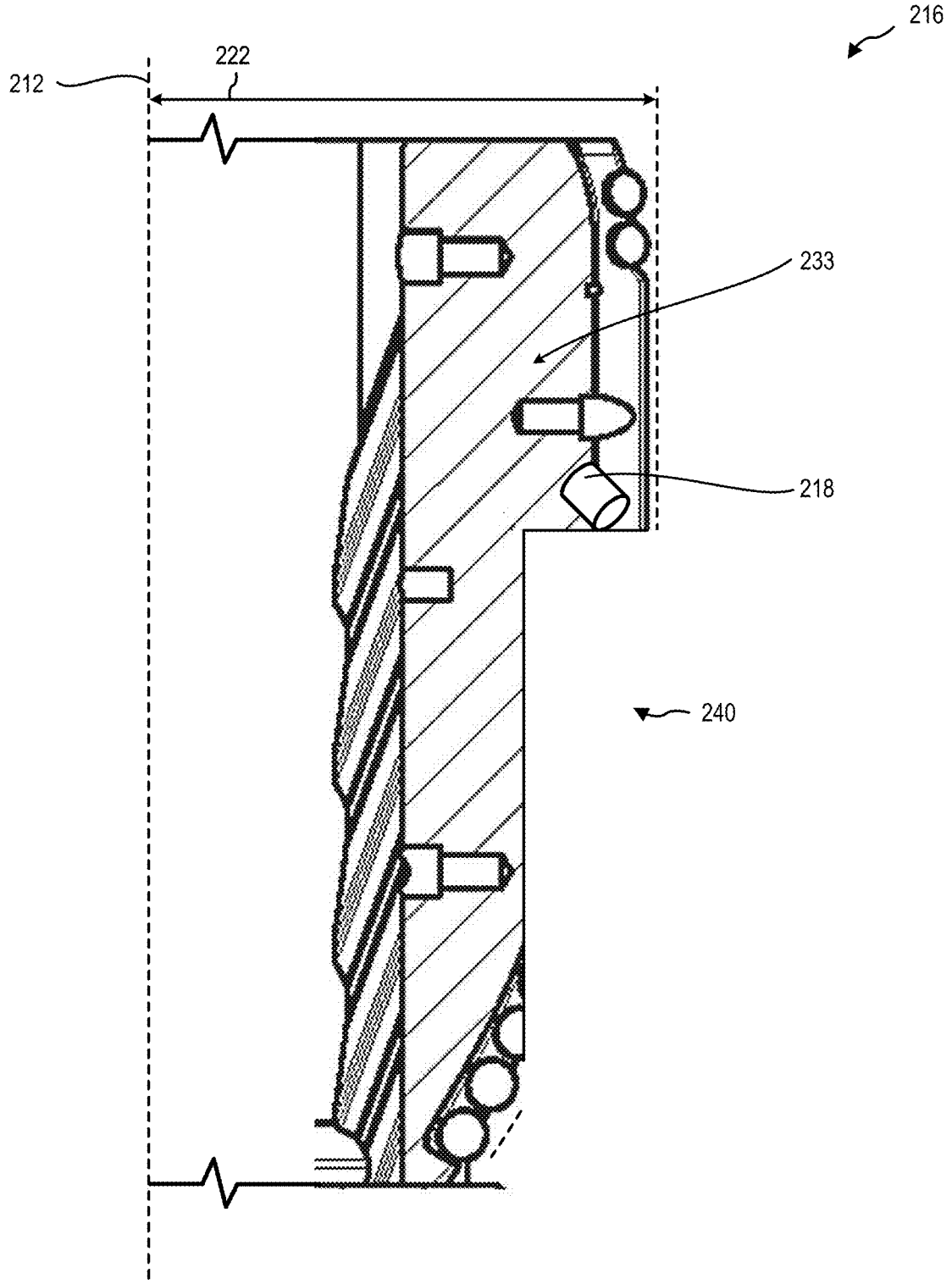

FIG. 5 is a schematic representation of a drilling parameter plot 554, according to at least one embodiment of the present disclosure. The drilling parameter plot 554 include drilling parameter measurements on the x-axis (e.g., horizontal axis) and time or depth on the y-axis (e.g., vertical axis). The drilling parameter plot 554 shown includes a SWOB plot 556 and a surface torque plot 568. The SWOB plot 556 may include measurements of SWOB taken by a SWOB sensor at the surface. The surface torque plot 568 may include measurements of surface torque taken at the surface.

The drilling parameter plot 554 may include a first measurement period 560. The first measurement period 560 may include measurements taken while the reamer is engaging the formation. As may be seen, the SWOB measurements in the SWOB plot 556 and the surface torque measurements in the surface torque plot 568 may be relatively constant (e.g., the SWOB and surface torque are consistent over the first measurement period 560). Further, the surface torque ratio between surface torque and the SWOB in the surface torque plot 568 and SWOB plot 556 may be relatively constant (e.g., the surface torque ratio is consistent over the first measurement period 560).

In a second measurement period 562, the measurements in the surface torque plot 568 may be significantly decreased while the SWOB has stayed the same or approximately the same. This may result in a decrease in the surface torque ratio. In some embodiments, a ringout detection system may identify the decrease in the surface torque with respect to the SWOB as an indication of ringout. In some embodiments, the ringout detection system may identify that a passive cutting element (e.g., a cutting element that is inefficient at cutting the formation) of the reamer has engaged the formation, resulting in a decrease in the torque applied to the drilling system by the reamer and the bit, resulting in a decrease in the surface torque. In some embodiments, the ringout detection system may identify that a brake element of the reamer has engaged the formation.

The drilling parameter plot 554 includes a third measurement period 564. In the third measurement period 564, the surface torque has returned to the same values in the first measurement period 560. This may indicate that a complete ringout has occurred and that the reamer is no longer applying torque to the drilling system.

In some embodiments, the ringout detection system may identify ringout only using the drilling parameter measurements in the second measurement period 562. For example, the ringout detection system may identify ringout based solely on the comparison between the surface torque and the SWOB in the second measurement period 562.

In some embodiments, the ringout detection system may identify ringout using a pattern of measurements across two or more of the first measurement period 560, the second measurement period 562, and the third measurement period 564. For example, the ringout detection system may identify the pattern of change in surface torque and/or the surface torque ratio between the first measurement period 560 and the second measurement period 562. Based on the pattern of change in surface torque and/or the surface torque ratio between the first measurement period 560 and the second measurement period 562, the ringout detection system may identify ringout. In some examples, the ringout detection system may identify the pattern of change in surface torque and/or the surface torque ratio between the second measurement period 562 and the third measurement period 564. Based on the pattern of change in surface torque and/or the surface torque ratio between the second measurement period 562 and the third measurement period 564, the ringout detection system may determine that ringout has occurred. In some examples, the ringout detection system may determine that ringout has occurred based on the pattern of change between the first measurement period 560, the second measurement period 562, and the third measurement period 564.

In some embodiments, the surface torque plot 568 may include a transition period 566 between the first measurement period 560 and the second measurement period 562. The transition period 566 may include a rate of change in the surface torque and/or a rate of change in the surface torque ratio. In some embodiments, the transition period 566 may include a pattern of surface torque readings. In some embodiments, the ringout detection system may determine that ringout is occurring based on the pattern of measurements in the transition period 566. In some embodiments, the ringout detection system may determine that ringout has occurred and/or is occurring based on the pattern of surface torque measurements in the transition period 566 followed by the values and/or patterns of the surface torque measurements in the second measurement period 562.

In some embodiments, the ringout detection system may determine ringout based on the surface torque measurements from the surface torque plot 568 alone. For example, the pattern of change in the surface torque measurements may indicate whether ringout has occurred. In some examples, the magnitude of change in the surface torque measurements may indicate that ringout has occurred. The ringout detection system may identify the changes in the surface torque across the first measurement period 560, the transition period 566, the second measurement period 562, the third measurement period 564, and combinations thereof.

Figures 2, 3, 4, 5, 6:
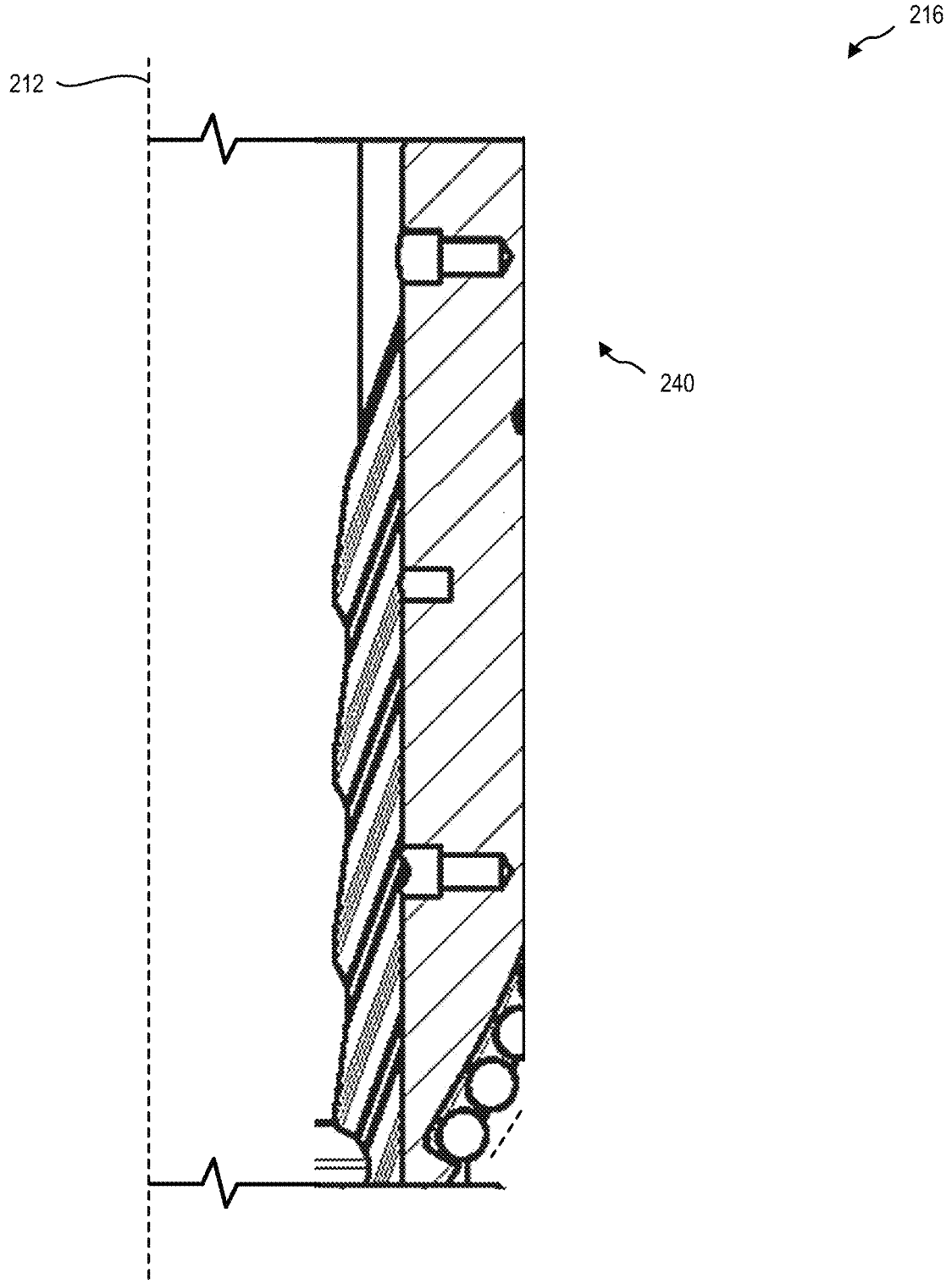
Figure 3:
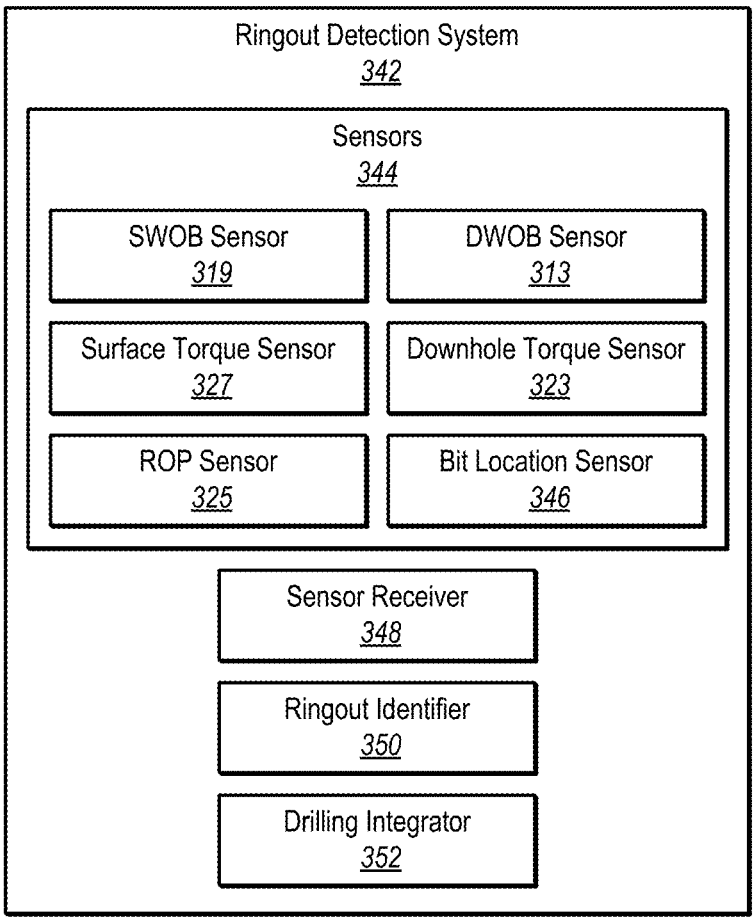
Figure 4:
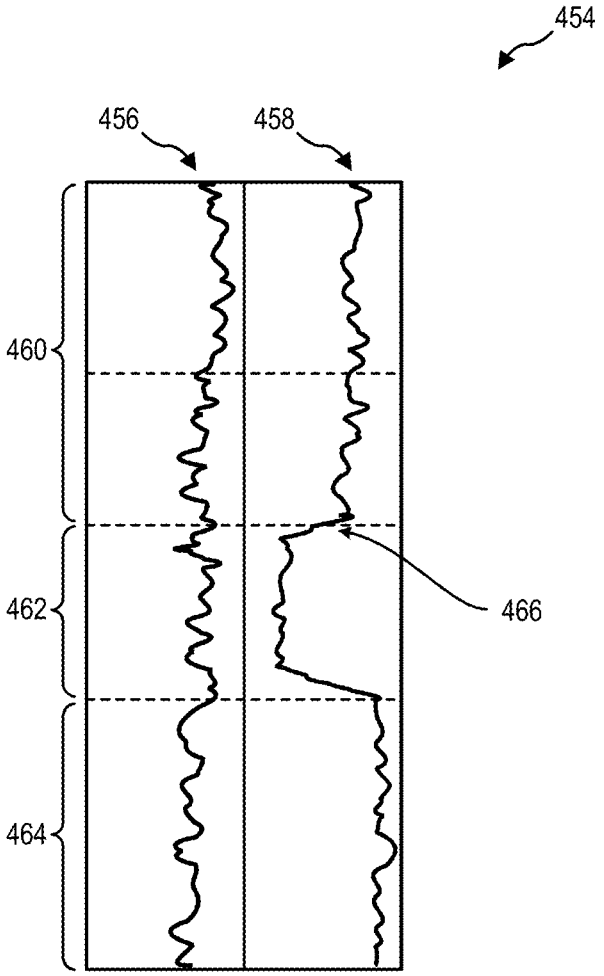
Figure 5:
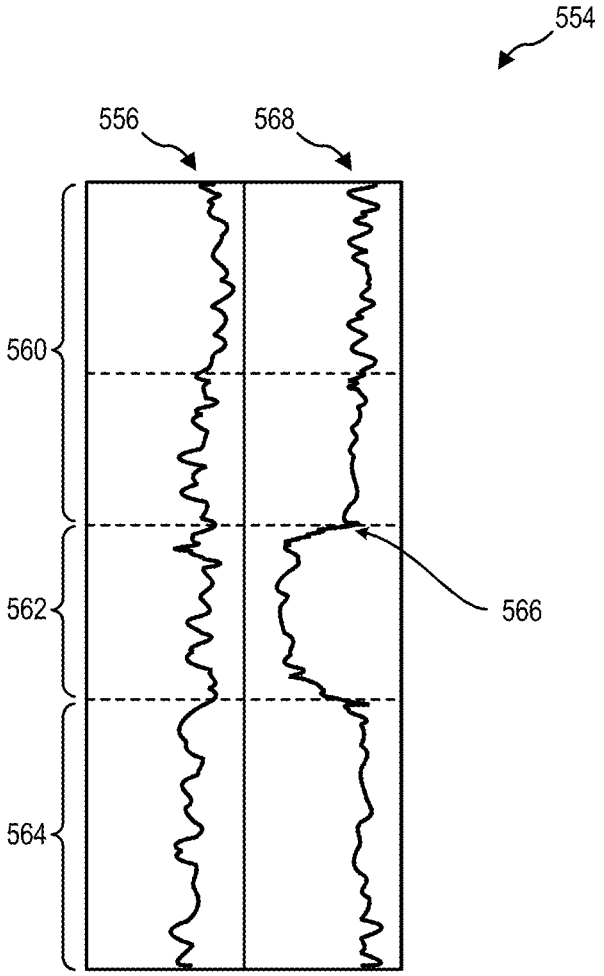
Figure 6:
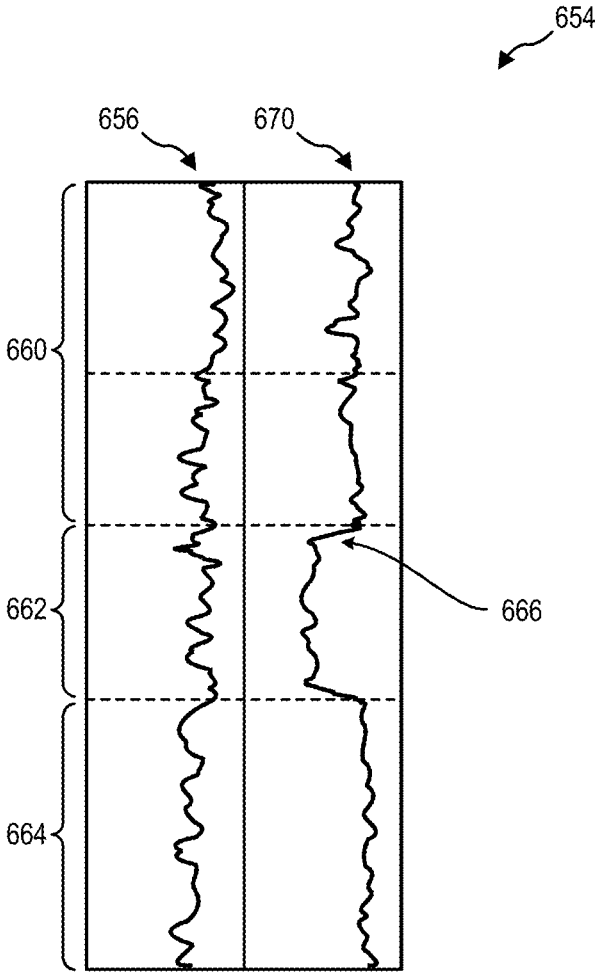

FIG. 6 is a schematic representation of a drilling parameter plot 654, according to at least one embodiment of the present disclosure. The drilling parameter plot 654 include drilling parameter measurements on the x-axis (e.g., horizontal axis) and time or depth on the y-axis (e.g., vertical axis). The drilling parameter plot 654 shown includes a SWOB plot 656 and a downhole torque plot 670. The SWOB plot 656 may include measurements of SWOB taken by a SWOB sensor at the surface. The downhole torque plot 670 may include measurements of downhole torque taken at the bit.

The drilling parameter plot 654 may include a first measurement period 660. The first measurement period 660 may include measurements taken while the reamer is engaging the formation. As may be seen, the SWOB measurements in the SWOB plot 656 and the downhole torque measurements in the downhole torque plot 670 may be relatively constant (e.g., the SWOB and the downhole torque are consistent over the first measurement period 660). Further, the downhole torque ratio between downhole torque and the SWOB in the downhole torque plot 670 and SWOB plot 656 may be relatively constant (e.g., the downhole torque ratio is consistent over the first measurement period 660).

In a second measurement period 662, the measurements in the downhole torque plot 670 may be significantly decreased while the SWOB has stayed the same or approximately the same. This may result in a decrease in the downhole torque ratio. In some embodiments, a ringout detection system may identify the decrease in the downhole torque with respect to the SWOB as an indication of ringout. In some embodiments, the ringout detection system may identify that a passive cutting element (e.g., a cutting element that is inefficient at cutting the formation) has engaged the formation, resulting in a decrease in the torque applied to the drilling system by the reamer and the bit, resulting in a decrease in the downhole torque. In some embodiments, the ringout detection system may identify that a brake element has engaged the formation.

The drilling parameter plot 654 includes a third measurement period 664. In the third measurement period 664, the downhole torque has returned to the same values in the first measurement period 660. This may indicate that a complete ringout has occurred and that the reamer is no longer applying torque to the drilling system.

In some embodiments, the ringout detection system may identify ringout only using the drilling parameter measurements in the second measurement period 662. For example, the ringout detection system may identify ringout based solely on the comparison between the downhole torque and the SWOB in the second measurement period 662.

In some embodiments, the ringout detection system may identify ringout using a pattern of measurements across two or more of the first measurement period 660, the second measurement period 662, and the third measurement period 664. For example, the ringout detection system may identify the pattern of change in downhole torque and/or the downhole torque ratio between the first measurement period 660 and the second measurement period 662. Based on the pattern of change in downhole torque and/or the downhole torque ratio between the first measurement period 660 and the second measurement period 662, the ringout detection system may identify ringout. In some examples, the ringout detection system may identify the pattern of change in downhole torque and/or the downhole torque ratio between the second measurement period 662 and the third measurement period 664. Based on the pattern of change in downhole torque and/or the downhole torque ratio between the second measurement period 662 and the third measurement period 664, the ringout detection system may determine that ringout has occurred. In some examples, the ringout detection system may determine that ringout has occurred based on the pattern of change between the first measurement period 660, the second measurement period 662, and the third measurement period 664.

In some embodiments, the downhole torque plot 670 may include a transition period 666 between the first measurement period 660 and the second measurement period 662. The transition period 666 may include a rate of change in the downhole torque and/or a rate of change in the downhole torque ratio. In some embodiments, the transition period 666 may include a pattern of downhole torque readings. In some embodiments, the ringout detection system may determine that ringout is occurring based on the pattern of measurements in the transition period 666. In some embodiments, the ringout detection system may determine that ringout has occurred and/or is occurring based on the pattern of downhole torque measurements in the transition period 666 followed by the values and/or patterns of the downhole torque measurements in the second measurement period 662.

In some embodiments, the ringout detection system may determine ringout based on the downhole torque measurements from the downhole torque plot 670 alone. For example, the pattern of change in the downhole torque measurements may indicate whether ringout has occurred. In some examples, the magnitude of change in the downhole torque measurements may indicate that ringout has occurred. The ringout detection system may identify the changes in the downhole torque across the first measurement period 660, the transition period 666, the second measurement period 662, the third measurement period 664, and combinations thereof.

Figure 7:
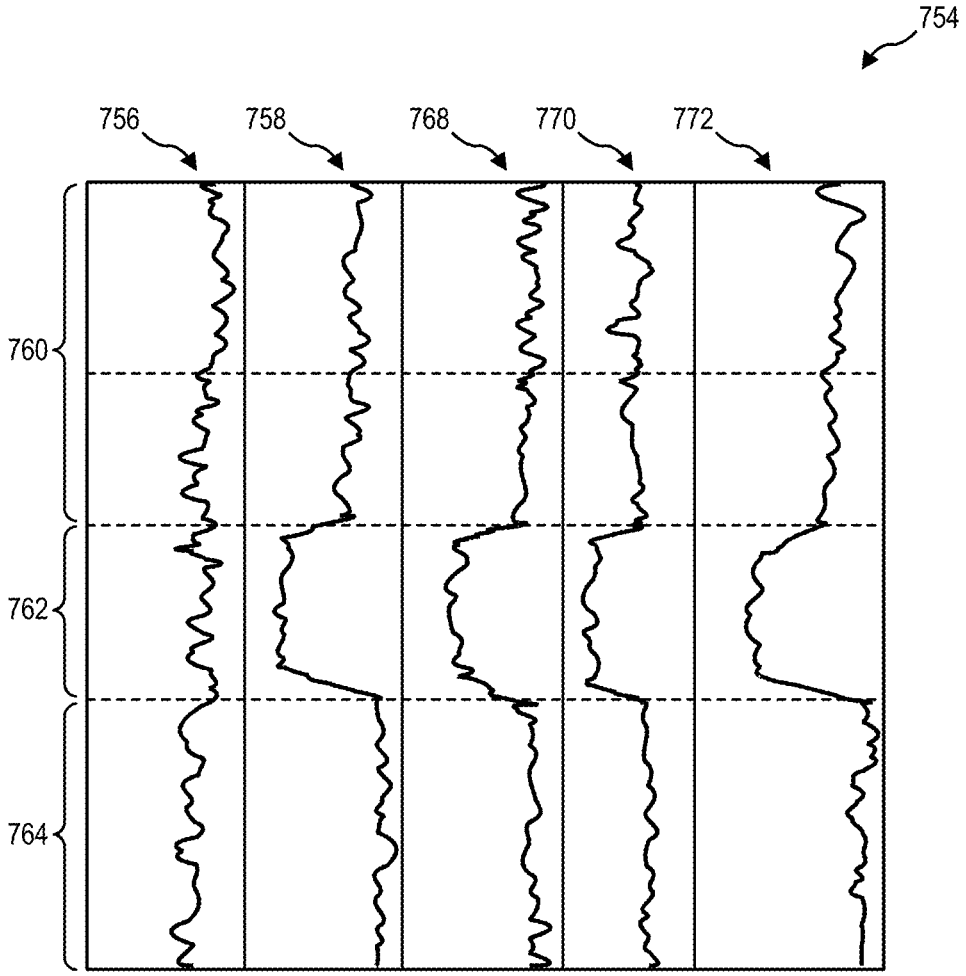
FIG. 7 is a schematic representation of a drilling parameter plot, according to at least one embodiment of the present disclosure.

FIG. 7 is a schematic representation of a drilling parameter plot 754, according to at least one embodiment of the present disclosure. The drilling parameter plot 754 include drilling parameter measurements on the x-axis (e.g., horizontal axis) and time or depth on the y-axis (e.g., vertical axis). The drilling parameter plot 754 shown includes a SWOB plot 756, a DWOB plot 758, a surface torque plot 768, a downhole torque plot 770, and an ROP plot 772. The SWOB plot 756 may include measurements of SWOB taken by a SWOB sensor at the surface. The DWOB plot 758 may include measurements of DWOB taken by a DWOB sensor at the bit. The surface torque plot 768 may include measurements of surface torque taken by a surface torque sensor at the surface. The downhole torque plot 770 may include measurements of downhole torque taken by a downhole torque sensor at the bit. The ROP plot 772 may include measurements of ROP taken by an ROP sensor at the surface.

The drilling parameter plot 754 may include a first measurement period 760. The first measurement period 760 may include measurements taken while the reamer is engaging the formation. As may be seen, each of the measurements in the SWOB plot 756, the DWOB plot 758, the surface torque plot 768, the downhole torque plot 770, and the ROP plot 772 may be consistent or relatively consistent over the first measurement period 760.

In a second measurement period 762, the measurements in the DWOB plot 758, the surface torque plot 768, the downhole torque plot 770, and the ROP plot 772 may be significantly decreased while the SWOB has stayed the same or approximately the same. A ringout detection system may identify ringout based on the reduction in these values based on a comparison with the SWOB. In some embodiments, the ringout detection system may identify one or more ratios and/or comparisons among the various parameters of the drilling parameter plot 754. In some embodiments, the ringout detection system may use the one or more ratios and/or comparisons to determine that ringout has occurred.

In some embodiments, the ringout detection system may utilize the ROP from the ROP plot 772 to validate whether ringout has occurred. For example, the ringout detection system may validate whether ringout has occurred by identifying whether the ROP reduction was while the DWOB, surface torque, and/or downhole torque are reduced. This may help to improve the accuracy and/or reliability of the determination of ringout. After ringout occurs and the reamer is fully rungout, the drilling parameter measurements may return to consistent values in a third measurement period 764.

Figure 8:
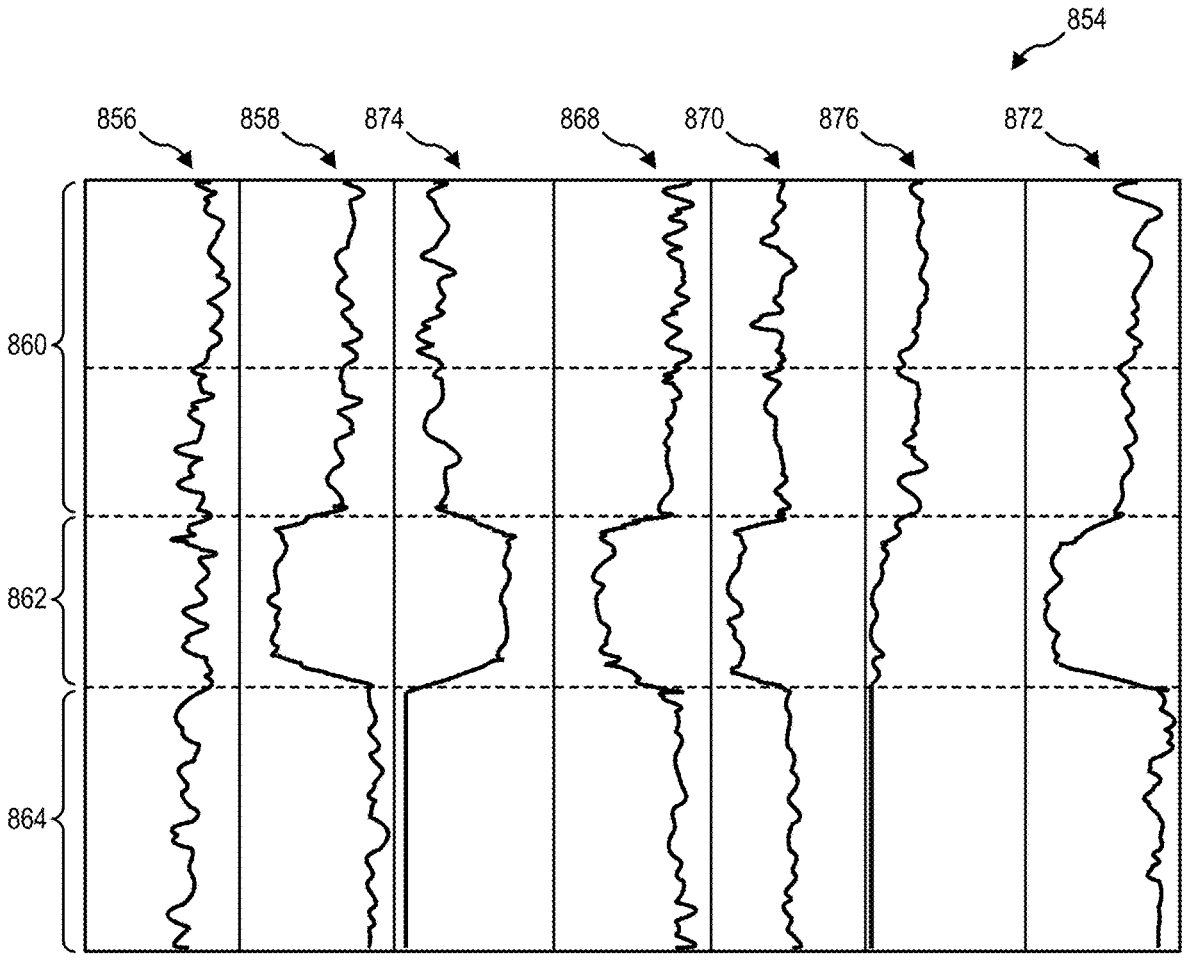
FIG. 8 is a schematic representation of a drilling parameter plot, according to at least one embodiment of the present disclosure.

FIG. 8 is a schematic representation of a drilling parameter plot 854, according to at least one embodiment of the present disclosure. The drilling parameter plot 854 include drilling parameter measurements on the x-axis (e.g., horizontal axis) and time or depth on the y-axis (e.g., vertical axis). The drilling parameter plot 854 shown includes a SWOB plot 856, a DWOB plot 858, a surface torque plot 868, a downhole torque plot 870, and an ROP plot 872. The SWOB plot 856 may include measurements of SWOB taken by a SWOB sensor at the surface. The DWOB plot 858 may include measurements of DWOB taken by a DWOB sensor at the bit. The surface torque plot 868 may include measurements of surface torque taken by a surface torque sensor at the surface. The downhole torque plot 870 may include measurements of downhole torque taken by a downhole torque sensor at the bit. The ROP plot 872 may include measurements of ROP taken by an ROP sensor at the surface.

The ringout detection system may calculate or determine a DWOR using the SWOB plot 856 and DWOB plot 858. This may result in a DWOR plot 874. In some embodiments, the DWOR plot 874 may be generated using measured values from a sensor in the reamer blade. In some embodiments, the ringout detection system may calculate or determine a DTOR using the surface torque plot 868 and downhole torque plot 870. This may result in a DTOR plot 876. In some embodiments, the DTOR plot 876 may be generated using measured values from a sensor in the reamer blade.

The drilling parameter plot 854 may include a first measurement period 860. The first measurement period 860 may include measurements taken while the reamer is engaging the formation. As may be seen, each of the measurements in the SWOB plot 856, the DWOB plot 858, the surface torque plot 868, the downhole torque plot 870, the ROP plot 872, the DWOR plot 874, and the DTOR plot 876 may be constant or relatively constant.

In a second measurement period 862, the measurements in the DWOB plot 858, the surface torque plot 868, the downhole torque plot 870, and the ROP plot 872 may be significantly decreased while the SWOB has stayed the same or approximately the same. This may result in the DWOR to be increased, as may be seen in the DWOR plot 874. The DTOR may be decreased, as may be seen in the DTOR plot 876. In some embodiments, a ringout detection system may determine ringout based on the determined and/or calculated DWOR and/or DTOR. For example, the ringout detection system may determine ringout based on the increase of DWOR in the second measurement period 862. In some examples, the ringout detection system may determine ringout based on the decrease in DTOR during the second measurement period 862.

When the ringout detection system identifies ringout, the ringout detection system may determine that there is no signal for the DWOR and/or the DTOR in a third measurement period 864. This may result in the ringout detection system determining that ringout is complete.

Figures 1, 9:
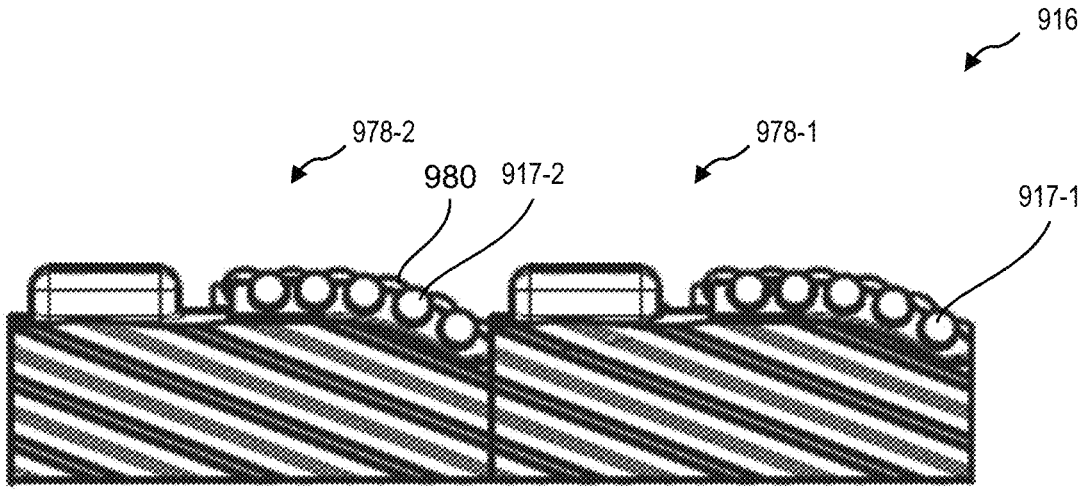
Figures 2, 9:
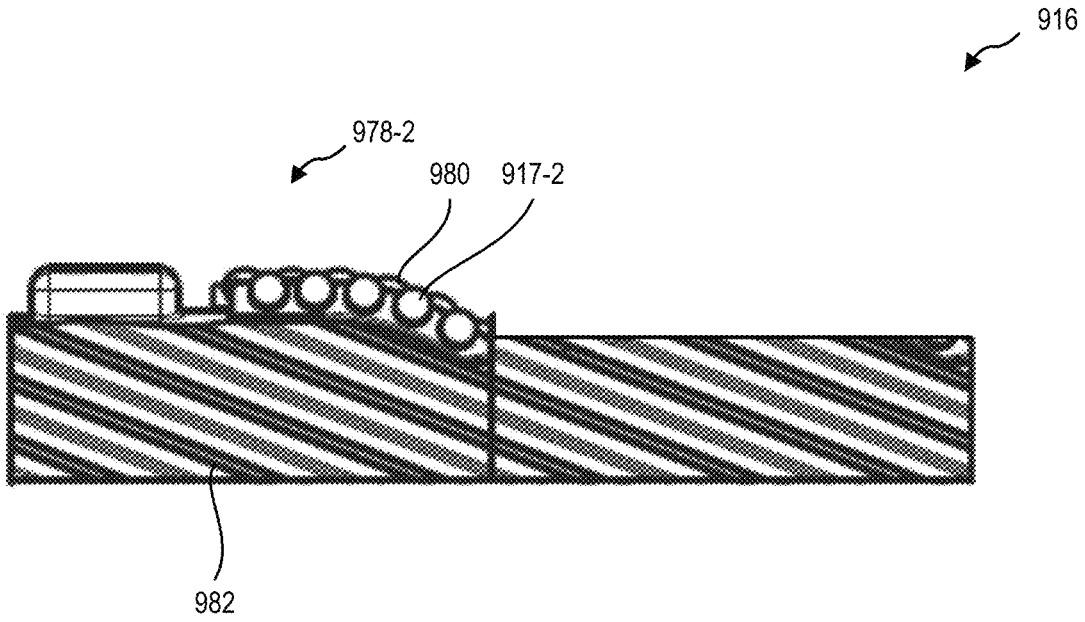

FIG. 9-1 and FIG. 9-2 are representations of an expandable block 916 that may experience wear, according to at least one embodiment of the present disclosure. The expandable block 916 may include a multi-profile reamer, including a first reamer profile 978-1 and a second reamer profile 978-2. While the embodiment of FIG. 9-1 and FIG. 9-2 includes two profiles, it should be understood that the expandable block 916 may have any number of profiles, including 1, 2, 3, 4, 5, 6, 7, 8, 9, 10 or more profiles. The first reamer profile 978-1 may engage the formation first. The second reamer profile 978-2 may be a backup reamer profile. This may extend the operational life of the expandable block 916.

The first reamer profile 978-1 of the expandable block 916 includes a first set of cutting elements 917-1. When the first reamer profile 978-1 experiences wear, the first set of cutting elements 917-1 may wear away and/or fall off the expandable block 916. This may cause the first reamer profile 978-1 to wear away, as may be seen in FIG. 9-2.

The second reamer profile 978-2 includes a second set of cutting elements 917-2 and a passive cutting element 980. The passive cutting element 980 may extend past the second set of cutting elements 917-2. For example, the passive cutting element 980 may have a greater exposure than the elements 917-2. When the second reamer profile 978-2 wears away, the passive cutting element 980 may engage the formation first (e.g., before the second set of cutting element 917-2).

The passive cutting element 980 may be oriented to be inefficient at cutting the formation. When the passive cutting element 980 engages the formation, the passive cutting element 980 may slide along the formation and may not cut the formation. In some embodiments, the passive cutting element 980 cuts the formation with significantly less efficiency than a conventional cutting element, thereby affecting the torque on the reamer. That is, a passive cutting element may be configured to remove less of a formation and generate less torque on the reamer than an active cutting element under the same conditions. This may cause the expandable block 916 to support at least a portion of the weight of the drilling system. In some embodiments, the passive cutting element 980 may be a brake element. In some embodiments, the brake element may be arranged in the expandable block 916 to engage the formation in a manner that significantly reduces the ROP of the drill string.

In accordance with at least one embodiment of the present disclosure, a ringout detection system may identify when the passive cutting element 980 engages the formation. For example, the ringout detection system may identify the change in the DWOB and/or the torque of the system when the passive cutting element 980 scrapes along the formation. In this manner, the ringout detection system may identify when the first reamer profile 978-1 wears and when the second reamer profile 978-2 has engaged the formation. This may help the drilling operator to identify when ringout of the first reamer profile 978-1 has occurred. In this manner, the drilling operator may understand the wear status of the expandable block 916.

As may be understood, the expandable block 916 may include one or more brake elements embedded in a body 982 of the expandable block 916. The embedded brake elements may help to identify when one or both of the first reamer profile 978-1 or second reamer profile 978-2 has experienced ringout. In some embodiments, the embedded brake element may be in addition to the passive cutting element 980 located on the outer surface of the second reamer profile 978-2. In some embodiments, the expandable block 916 may only include the embedded brake elements.

In some embodiments, the ringout detection system may distinguish between ringout in the first reamer profile 978-1 or the second reamer profile 978-2. For example, the first reamer profile 978-1 may include one or more passive elements and/or brake elements that are associated with a first pattern of drilling parameter measurements and/or a first magnitude of change in the measurement ratios. The second reamer profile 978-2 may include one or more passive elements and/or brake elements that are associated with a second pattern of drilling parameter measurements and/or a second magnitude of change in the measurement ratios. The ringout detection system may analyze the drilling parameter measurements for a pattern and/or magnitude of measurements or measurement ratios. Using the determined patterns and/or magnitudes, the ringout detection system may determine whether the ringout has occurred in the first reamer profile 978-1 or the second reamer profile 978-2.

Figure 10:
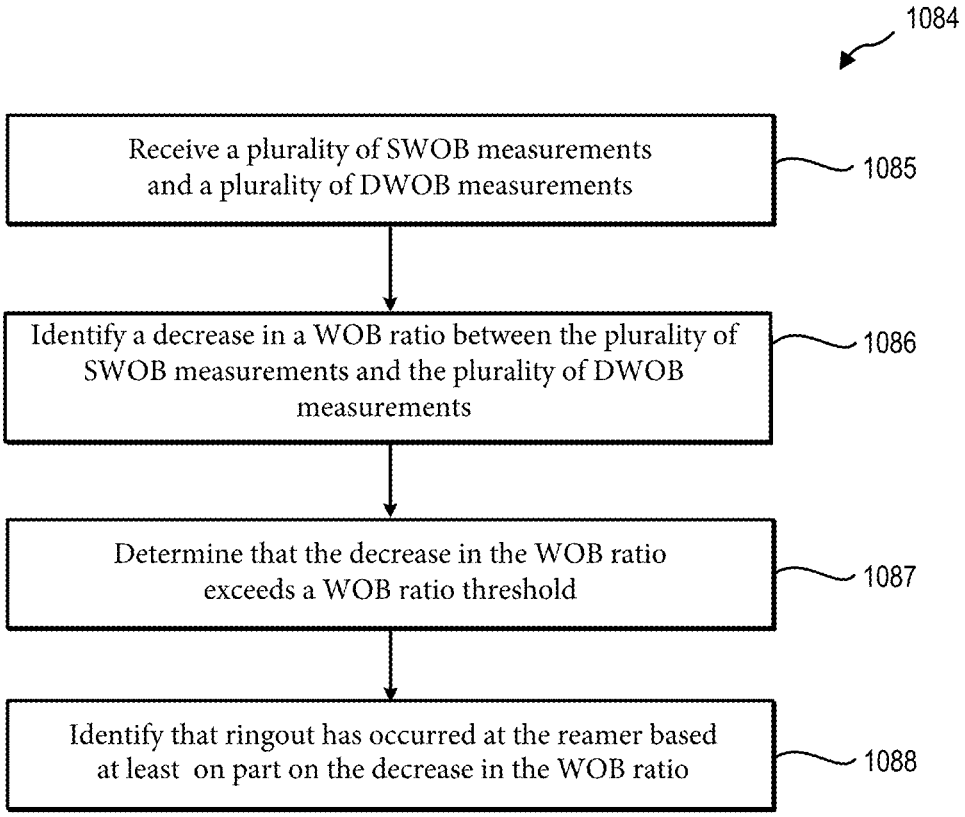
FIG. 10 is a flowchart of a method for identifying ringout; according to at least one embodiment of the present disclosure.
Figure 11:
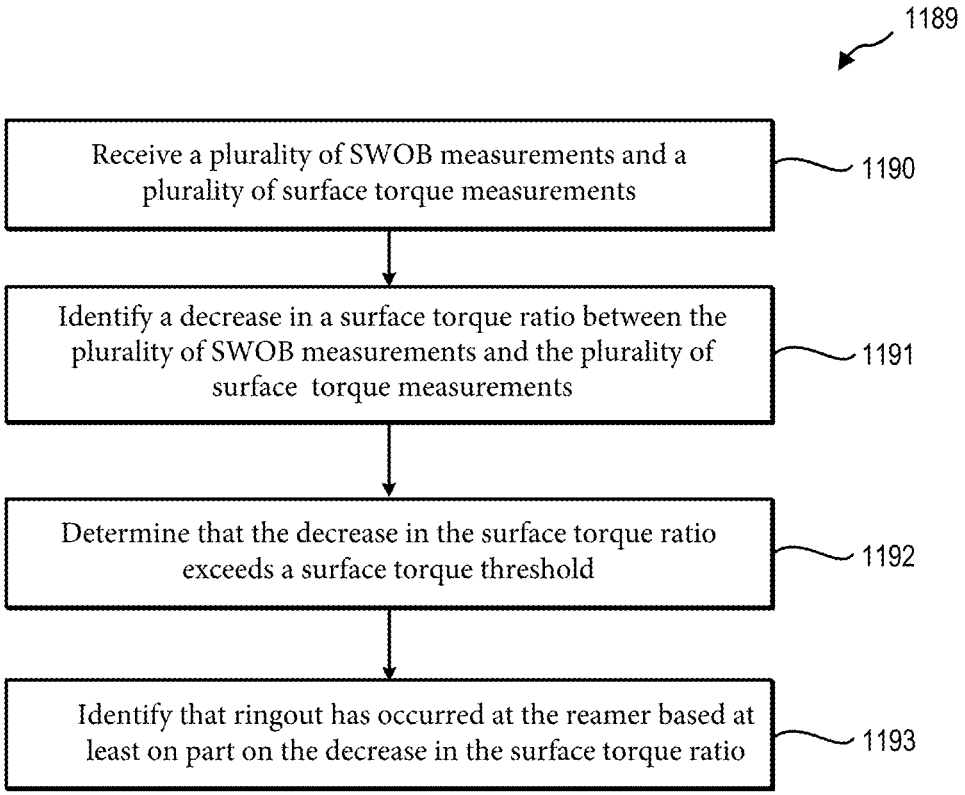
FIG. 11 is a flowchart of a method for identifying ringout; according to at least one embodiment of the present disclosure.
Figure 12:
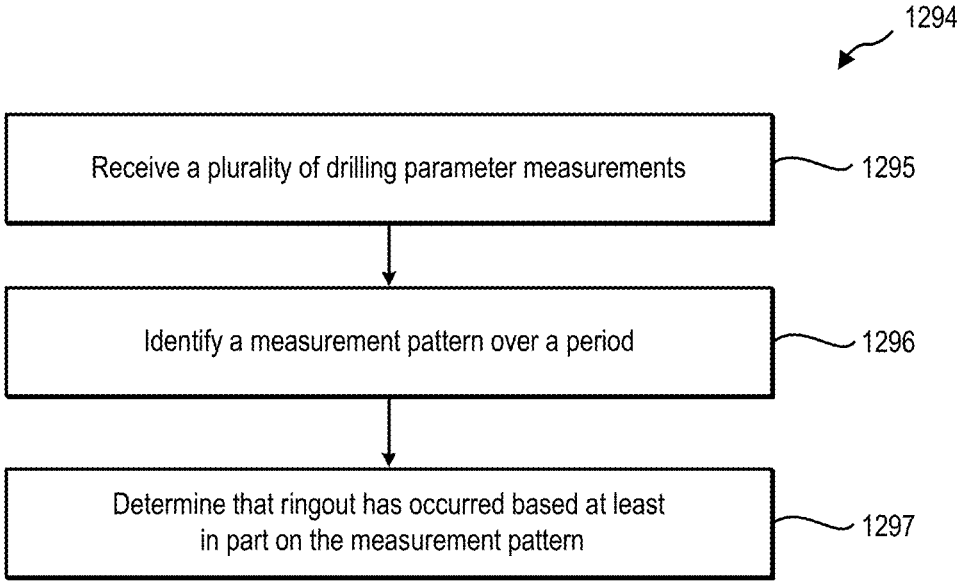
FIG. 12 is a flowchart of a method for identifying ringout; according to at least one embodiment of the present disclosure.

FIG. 10-12, the corresponding text, and the examples provide a number of different methods, systems, devices, and computer-readable media of the ringout detection system. In addition to the foregoing, one or more embodiments can also be described in terms of flowcharts comprising acts for accomplishing a particular result, as shown in FIG. 10-12. FIG. 10-12 may be performed with more or fewer acts. Further, the acts may be performed in differing orders. Additionally, the acts described herein may be repeated or performed in parallel with one another or parallel with different instances of the same or similar acts.

As mentioned, FIG. 10 illustrates a flowchart of a method 1084 or a series of acts for determining ringout, in accordance with at least one embodiment of the present disclosure. While FIG. 10 illustrates acts according to one embodiment, alternative embodiments may omit, add to, reorder, and/or modify any of the acts shown in FIG. 10. The acts of FIG. 10 can be performed as part of a method. Alternatively, a computer-readable medium can comprise instructions that, when executed by one or more processors, cause a computing device to perform the acts of FIG. 10. In some embodiments, a system can perform the acts of FIG. 10.

The ringout detection system may receive a plurality of SWOB measurements and a plurality of DWOB measurements at 1085. The SWOB measurements may be received from an SWOB sensor located at the surface and the DWOB measurements may be received from a DWOB sensor located downhole. The ringout detection system may identify a decrease in a WOB ratio between the plurality of SWOB measurements and the plurality of DWOB measurements at 1086. The ringout detection system may determine that the decrease in the WOB ratio exceeds a WOB ratio threshold at 1087. The ringout detection system may identify that ringout has occurred at the reamer based at least in part on the decrease in the WOB ratio at 1088.

In some embodiments, the ringout detection system may determine that a passive element has engaged the formation based on the decrease in the WOB ratio. In some embodiments, the ringout detection system may determine that a brake element has engaged the formation based on the decrease in the WOB ratio.

As mentioned, FIG. 11 illustrates a flowchart of a method 1189 or a series of acts for determining ringout, in accordance with at least one embodiment of the present disclosure. While FIG. 11 illustrates acts according to one embodiment, alternative embodiments may omit, add to, reorder, and/or modify any of the acts shown in FIG. 11. The acts of FIG. 11 can be performed as part of a method. Alternatively, a computer-readable medium can comprise instructions that, when executed by one or more processors, cause a computing device to perform the acts of FIG. 11. In some embodiments, a system can perform the acts of FIG. 11.

The ringout detection system may receive a plurality of SWOB measurements and a plurality of surface torque measurements at 1190. The SWOB measurements may be received from an SWOB sensor located at the surface and the surface torque measurements may be received from a surface torque sensor located at the surface. The ringout detection system may identify a decrease in a surface torque ratio between the plurality of SWOB measurements and the plurality of surface torque measurements at 1191. The ringout detection system may determine that the decrease in the surface torque ratio exceeds a WOB ratio threshold at 1192. The ringout detection system may identify that ringout has occurred at the reamer based at least in part on the decrease in the WOB ratio at 1193.

In some embodiments, the ringout detection system may determine that a passive element has engaged the formation based on the decrease in the surface torque ratio. In some embodiments, the ringout detection system may determine that a brake element has engaged the formation based on the decrease in the surface torque ratio.

As mentioned, FIG. 12 illustrates a flowchart of a method 1294 or a series of acts for determining ringout, in accordance with at least one embodiment of the present disclosure. While FIG. 12 illustrates acts according to one embodiment, alternative embodiments may omit, add to, reorder, and/or modify any of the acts shown in FIG. 12. The acts of FIG. 12 can be performed as part of a method. Alternatively, a computer-readable medium can comprise instructions that, when executed by one or more processors, cause a computing device to perform the acts of FIG. 12. In some embodiments, a system can perform the acts of FIG. 12.

The ringout detection system may receive a plurality of drilling parameter measurements at 1295. For example, the ringout detection system may receive SWOB measurements from a SWOB sensor, DWOB measurements from a DWOB sensor, surface torque measurements from a surface torque sensor, downhole torque measurements from a downhole torque sensor, and a ROP from an ROP sensor.

The ringout detection system may identify a measurement pattern over a period at 1296. The measurement pattern may be any measurement pattern. For example, the measurement pattern may include a DWOB decrease in the DWOB measurements. In some examples, the measurement pattern may include a downhole torque decrease in the downhole torque measurements. In some examples, the measurement pattern may include a surface torque decrease in the surface torque measurements. In some examples, the measurement pattern may include an ROP decrease. In some examples, the measurement pattern may include a constant SWOB in the SWOB measurements. In some embodiments, the ringout detection system may determine that ring has occurred based at least in part on the measurement pattern at 1297.

In some embodiments, the ringout detection system may determine that a passive element has engaged the formation based on the decrease in the surface torque ratio. In some embodiments, the ringout detection system may determine that a brake element has engaged the formation based on the decrease in the surface torque ratio.

The embodiments of ringout detection system have been primarily described with reference to wellbore drilling operations; the ringout detection systems described herein may be used in applications other than the drilling of a wellbore. In other embodiments, ringout detection systems according to the present disclosure may be used outside a wellbore or other downhole environment used for the exploration or production of natural resources. For instance, ringout detection systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

Figure 13:
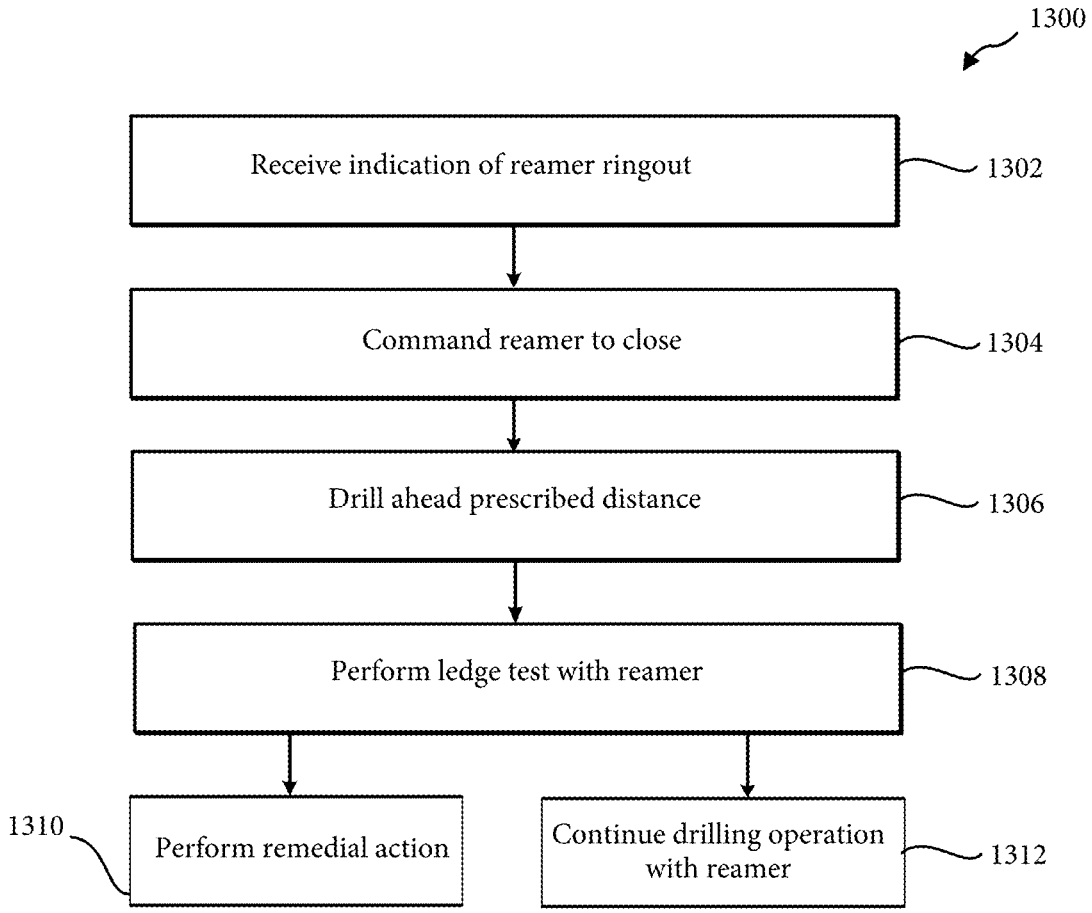
FIG. 13 is a flowchart of a method for verifying a ringout; according to at least one embodiment of the present disclosure.

FIG. 13 illustrates a method 1300 that may be implemented to verify a ringout indication by the ringout detection system as discussed above. Upon receipt of an indicator at 1302 that a ringout has occurred at the reamer, a command may be given at 1304 to close the reamer. The command may be a hydraulic command, EM command, wired command, ball drop, any combination thereof, or another command as appreciated in the field of downhole tools. After closing the reamer at 1304, the drill string may be directed at 1306 to drill ahead a prescribed distance, such as 5 feet, 10 feet, 15 feet, or 30 feet or more. A ledge test is performed at 1308 to determine if the reamer is rung out. During the ledge test, the drill string is raised more than the prescribed distance, the reamer is activated to extend any reamer blocks, and then the drill string is lowered. Detection of weight relief on the drill string from reamer block engagement with a ledge indicates that the reamer is not completely rung out; however, no weight relief to the drill string during the ledge test despite reamer activation confirms that the reamer is rung out as indicated by the ringout detection system at 1302. Confirmation of reamer ringout may lead to a remedial action at 1310 such as pulling the drill string from the hole, activating a secondary reamer, or adjusting a drilling plan. If the reamer is not rung out, then further testing, drilling, and/or reaming operations may be conducted at 1312.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method implemented in a drilling system operating a reamer and a bit, the method comprising:

receiving a plurality of surface weight-on-bit (SWOB) measurements from a surface weight-on-bit (WOB) sensor and a plurality of downhole weight-on-bit (DWOB) measurements from a downhole WOB sensor;

identifying a decrease in a WOB ratio between the plurality of SWOB measurements and the plurality of DWOB measurements;

determining that the decrease in the WOB ratio exceeds a WOB ratio threshold; and identifying that a ringout has occurred at the reamer based at least in part on the decrease in the WOB ratio.

2. The method of claim 1, further comprising determining that a passive element has engaged a formation based on the decrease in the WOB ratio.

3. The method of claim 2, further comprising determining that the passive element is a brake element embedded in a body of an expandable block of the reamer based on a magnitude of the decrease in the WOB ratio.

4. The method of claim 2, wherein the reamer is a multi-profile reamer having a first profile and a second profile, and further comprising determining that the ringout has occurred in the first profile based on at least one of a measurement pattern or a magnitude of the decrease in the WOB ratio.

5. The method of claim 2, wherein the reamer is a multi-profile reamer having a first profile and a second profile, and further comprising determining that the ringout has occurred in the second profile based on at least one of a measurement pattern or a magnitude of the decrease in the WOB ratio.

6. The method of claim 1, wherein the WOB ratio threshold includes a percent change in WOB ratio.

7. The method of claim 6, wherein the WOB ratio threshold is 75%.

8. The method of claim 6, wherein the WOB ratio threshold includes the percent change over at least one of a period of time or a quantity of measurements.

9. The method of claim 1, wherein identifying that the ringout has occurred is based at least in part on a decrease in a rate of penetration (ROP) during the decrease in the WOB ratio.

10. A method implemented in a drilling system operating a reamer and a bit, the method comprising:

receiving a plurality of surface weight-on-bit (SWOB) measurements from a surface weight-on-bit (WOB) sensor and a plurality of surface torque measurements from a surface torque sensor;

identifying a decrease in a surface torque ratio between the plurality of SWOB measurements and the plurality of surface torque measurements;

determining that the decrease in the surface torque ratio exceeds a surface torque threshold; and identifying that a ringout has occurred at the reamer based at least in part on the decrease in the surface torque ratio.

11. The method of claim 10, further comprising determining that a passive element has engaged a formation based on the decrease in the surface torque ratio.

12. The method of claim 11, further comprising determining that the passive element is a brake element embedded in a body of an expandable block of the reamer based on a magnitude of the decrease in the surface torque ratio.

13. The method of claim 10, wherein identifying that the ringout has occurred is based at least in part on a decrease in a rate of penetration (ROP) during the decrease in the surface torque ratio.

14. A method implemented in a drilling system operating a reamer and a bit, the method comprising:

receiving a plurality of surface weight-on-bit (SWOB) measurements from a surface weight-on-bit (WOB) sensor, a plurality of downhole weight-on-bit (DWOB) measurements from a downhole WOB sensor, a plurality of surface torque measurements from a surface torque sensor, a plurality of downhole torque measurements from a downhole torque sensor, and a rate of penetration (ROP);

identifying a measurement pattern over a period, the measurement pattern including a DWOB decrease in the plurality of DWOB measurements, a downhole torque decrease in the plurality of downhole torque measurements, a surface torque decrease based on the plurality of surface torque measurements, a ROP decrease, and a consistent SWOB of the plurality of SWOB measurements; and determining that a ringout has occurred based at least in part on the measurement pattern over the period.

15. The method of claim 14, further comprising determining that a passive element has engaged a formation based on identifying the measurement pattern over the period.

16. The method of claim 15, further comprising determining that the passive element is a brake element embedded in a body of an expandable block of the reamer based on the measurement pattern.

17. The method of claim 14, wherein identifying the measurement pattern over the period includes identifying the measurement pattern over a quantity of measurements of one or more of the plurality of SWOB measurements, the plurality of DWOB measurements, the plurality of surface torque measurements, the plurality of downhole torque measurements, or the rate of penetration.

18. The method of claim 14, wherein identifying the measurement pattern includes identifying a WOB ratio between the plurality of SWOB measurements and the plurality of DWOB measurements.

19. The method of claim 14, wherein identifying the measurement pattern includes identifying a surface torque ratio between the plurality of SWOB measurements and the plurality of surface torque measurements.

20. The method of claim 14, wherein identifying the measurement pattern includes identifying a relationship between one or more of the plurality of SWOB measurements, the plurality of DWOB measurements, the plurality of surface torque measurements, the plurality of downhole torque measurements, or the rate of penetration.

* * * * *